US009719150B2

(12) United States Patent
Slattery

(10) Patent No.: US 9,719,150 B2
(45) Date of Patent: Aug. 1, 2017

(54) METHODS OF FORMING A WORKPIECE MADE OF A NATURALLY AGING ALLOY

(71) Applicant: The Boeing Company, Chicago, IL (US)

(72) Inventor: Kevin Thomas Slattery, Saint Charles, MO (US)

(73) Assignee: The Boeing Company, Chicago, IL (US)

( * ) Notice: Subject to any disclaimer, the term of this patent is extended or adjusted under 35 U.S.C. 154(b) by 387 days.

(21) Appl. No.: 14/589,545

(22) Filed: Jan. 5, 2015

(65) Prior Publication Data

US 2016/0194728 A1 Jul. 7, 2016

(51) Int. Cl.

| | |
|---|---|
| ***C21D 8/02*** | (2006.01) |
| ***B21D 31/00*** | (2006.01) |
| ***C21D 9/46*** | (2006.01) |
| ***C22C 21/14*** | (2006.01) |
| ***C22C 21/16*** | (2006.01) |
| ***C22C 21/18*** | (2006.01) |

(Continued)

(52) U.S. Cl.

CPC ..... *C21D 8/0221* (2013.01); *B21D 31/005* (2013.01); *C21D 8/02* (2013.01); *C21D 8/0247* (2013.01); *C21D 9/46* (2013.01); *C22C 21/14* (2013.01); *C22C 21/16* (2013.01); *C22C 21/18* (2013.01); *C22F 1/002* (2013.01); *C22F 1/057* (2013.01)

(58) Field of Classification Search

CPC ..... C21D 8/02; C21D 8/0221; C21D 8/0247
USPC ..... 148/559
See application file for complete search history.

(56) References Cited

U.S. PATENT DOCUMENTS

2014/0326717 A1* 11/2014 Matsen ..... H05B 6/105 219/634

FOREIGN PATENT DOCUMENTS

| | | |
|---|---|---|
| EP | 1899089 B1 | 6/2012 |
| EP | 2559499 A1 | 2/2013 |

(Continued)

OTHER PUBLICATIONS

European Search Report May 24, 2016 for co-pending European Application No. 15196212.3.

(Continued)

*Primary Examiner* — Brian Walck
(74) *Attorney, Agent, or Firm* — Smith Moore Leatherwood LLP

(57) ABSTRACT

A method of forming a workpiece having an initial heat treatment and made of a naturally aging alloy to a final shape using an incremental sheet forming (ISF) machine having a coordinate system and a tool path corresponding to the final shape of the workpiece is disclosed. The method comprises positioning the workpiece in the ISF machine; performing an initial forming operation on the workpiece using the ISF machine; performing a final heat treatment on the workpiece; repositioning the workpiece in the ISF machine; and, with the workpiece in a final workpiece orientation in the ISF machine and the tool path of the ISF machine in a final tool-path orientation in the ISF machine, performing a final forming operation on the workpiece using the ISF machine to achieve the final shape of the workpiece. Intermediate heat treatments and intermediate forming operations in the ISF machine may also be performed.

20 Claims, 25 Drawing Sheets

(51) Int. Cl.
*C22F 1/00* (2006.01)
*C22F 1/057* (2006.01)

(56) References Cited

FOREIGN PATENT DOCUMENTS

| | | | |
|---|---|---|---|
| JP | 2003236626 | A | 8/2003 |
| KR | 20110124557 | A | 11/2011 |

OTHER PUBLICATIONS

Emmens, W.C., et al., "The Technology of Incremental Sheet Forming—A Brief Review of the History," University of Twente, The Netherlands, 2010 Elsevier.

* cited by examiner

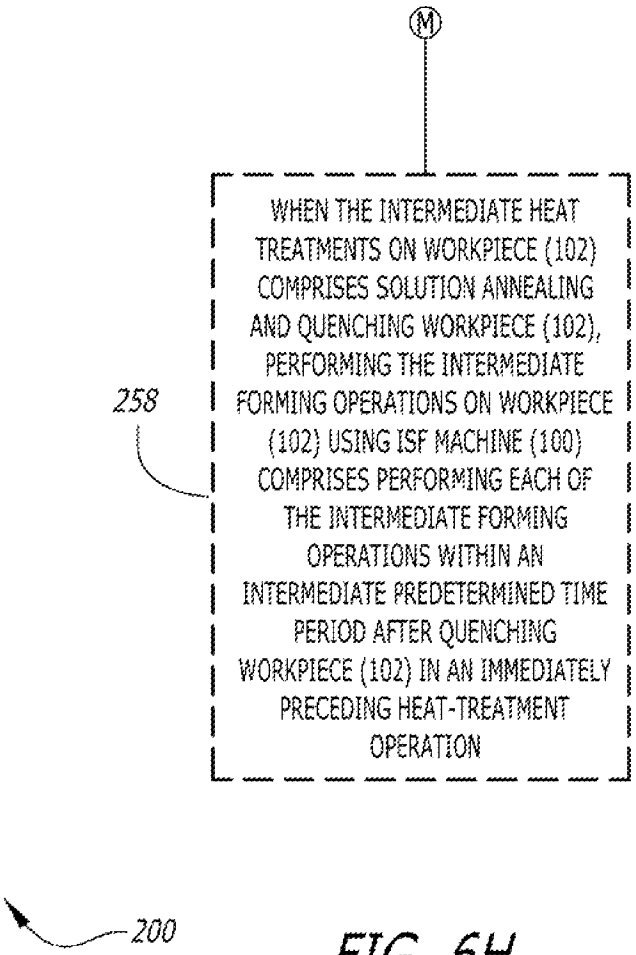
FIG. 6H
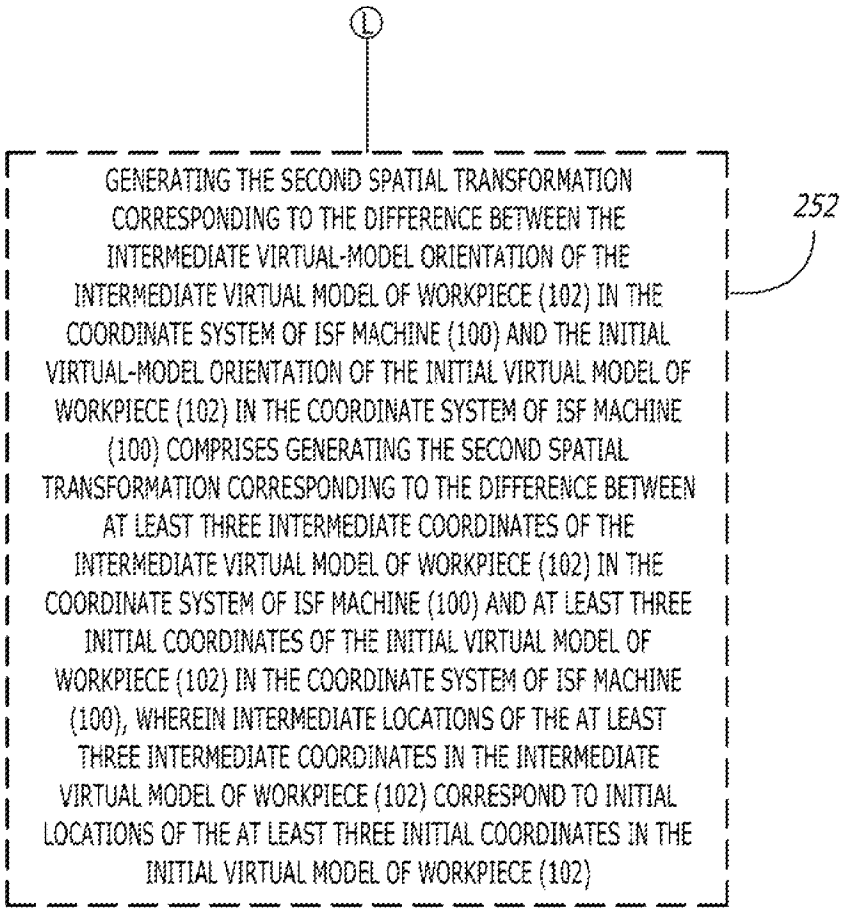

METHODS OF FORMING A WORKPIECE MADE OF A NATURALLY AGING ALLOY

BACKGROUND

When fabricating parts from metal sheet in low-production runs, incremental sheet forming (ISF) is an advantageous process. To improve the strength of the finished parts, the use of naturally aging alloys, such as certain alloys of aluminum, may be contemplated. However, since the hardness of the workpiece material increases in a relatively short time period due to the natural aging of such alloys, the window available for ISF operations may be insufficient, especially when complicated parts are being formed. ISF may therefore be limited in its ability to produce large and/or complicated parts when alloys, which harden due to natural aging, are utilized.

SUMMARY

Accordingly, methods, intended to address the above-identified concerns, would find utility.

The following is a non-exhaustive list of examples, which may or may not be claimed, of the subject matter according the present disclosure.

One example of the present disclosure relates to a method of forming a workpiece made of a naturally aging alloy to a final shape. The method comprises providing an ISF machine having a coordinate system and a tool path, corresponding to the final shape of the workpiece. The method also comprises performing an initial heat treatment on the workpiece. The method further comprises positioning the workpiece in the ISF machine in an initial workpiece orientation in the coordinate system of the ISF machine. The method also comprises, with the workpiece in the initial workpiece orientation in the coordinate system of the ISF machine and the tool path of the ISF machine in an initial tool-path orientation in the coordinate system of the ISF machine, performing an initial forming operation on the workpiece using the ISF machine. The method further comprises performing a final heat treatment on the workpiece. The method also comprises repositioning the workpiece in the ISF machine in a final workpiece orientation in the coordinate system of the ISF machine. The method further comprises, with the workpiece in the final workpiece orientation in the coordinate system of the ISF machine and the tool path of the ISF machine in a final tool-path orientation in the coordinate system of the ISF machine, performing a final forming operation on the workpiece using the ISF machine to achieve the final shape of the workpiece.

Another example of the present disclosure relates to a method of forming a workpiece made of a naturally aging alloy to a final shape. The workpiece has an initial heat treatment. The method comprises providing an ISF machine having a coordinate system and a tool path, corresponding to the final shape of the workpiece. The method also comprises positioning the workpiece in the ISF machine in an initial workpiece orientation in the coordinate system of the ISF machine. The method further comprises, with the workpiece in the initial workpiece orientation in the coordinate system of the ISF machine and the tool path of the ISF machine in an initial tool-path orientation in the coordinate system of the ISF machine, performing an initial forming operation on the workpiece using the ISF machine. The method also comprises performing a final heat treatment on the workpiece. The method further comprises repositioning the workpiece in the ISF machine in a final workpiece orientation in the coordinate system of the ISF machine. The method also comprises, with the workpiece in the final workpiece orientation in the coordinate system of the ISF machine and the tool path of the ISF machine in a final tool-path orientation in the coordinate system of the ISF machine, performing a final forming operation on the workpiece using the ISF machine to achieve the final shape of the workpiece.

BRIEF DESCRIPTION OF THE DRAWINGS

Having thus described examples of the present disclosure in general terms, reference will now be made to the accompanying drawings, which are not necessarily drawn to scale, and wherein like reference characters designate the same or similar parts throughout the several views, and wherein:

FIG. 1 is a block diagram of apparatus used in forming a workpiece, according to one or more examples of the present disclosure;

FIG. 2 is a schematic graphic representation of operations of a method of forming a workpiece, according to one or more examples of the present disclosure;

FIG. 3 is a schematic graphic representation of operations of another method of forming a workpiece, according to one or more examples of the present disclosure;

FIG. 4 is a schematic graphic representation of operations of still another method of forming a workpiece, according to one or more examples of the present disclosure;

FIG. 5 is a schematic graphic representation of operations of a further method of forming a workpiece, according to one or more examples of the present disclosure;

FIG. 6 shows relationships among FIGS. 6A-6H;

FIGS. 6A-6H are parts of a block diagram of a method of forming a workpiece, according to one or more examples of the present disclosure;

FIG. 7 shows relationships among FIGS. 7A-7H;

FIGS. 7A-7H are parts of a block diagram of a method of forming a workpiece, according to one or more examples of the present disclosure;

FIG. 8 is a block diagram of aircraft production and service methodology; and FIG. 9 is a schematic illustration of an aircraft.

DETAILED DESCRIPTION

Figure 6:
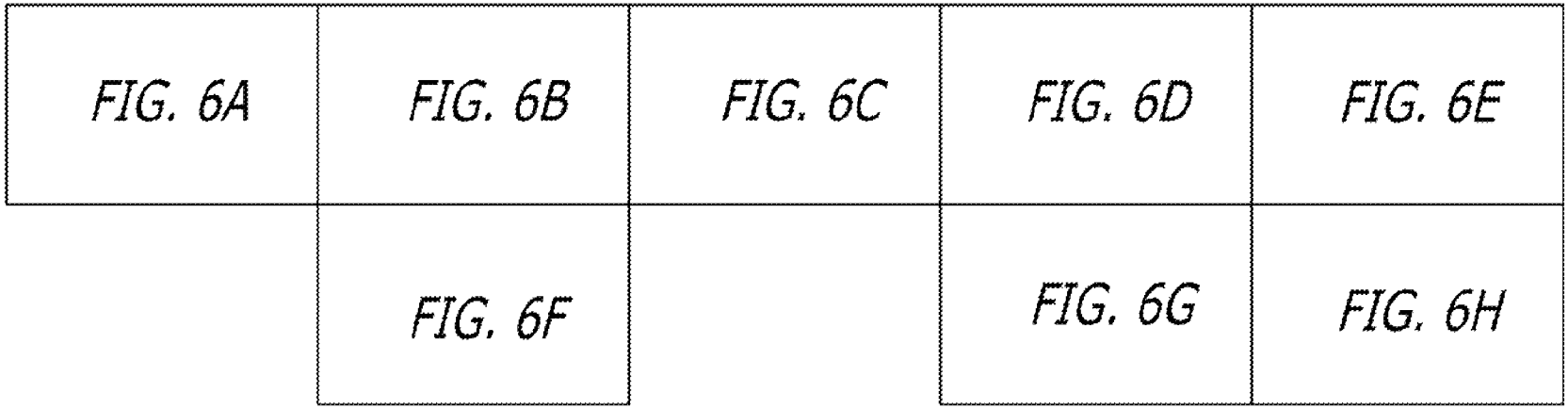
Figure 7:
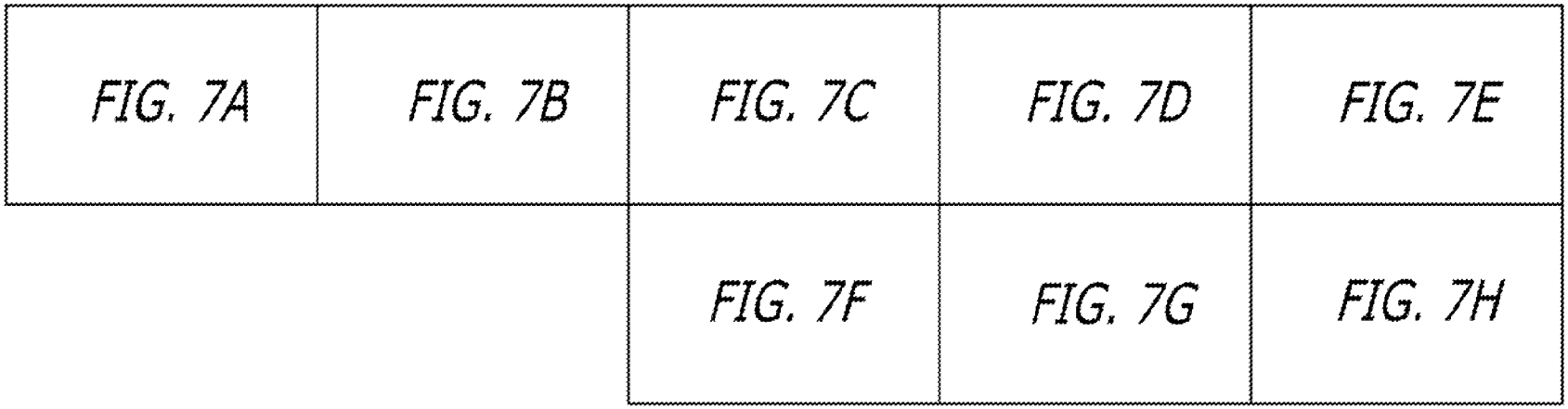
Figure 8:
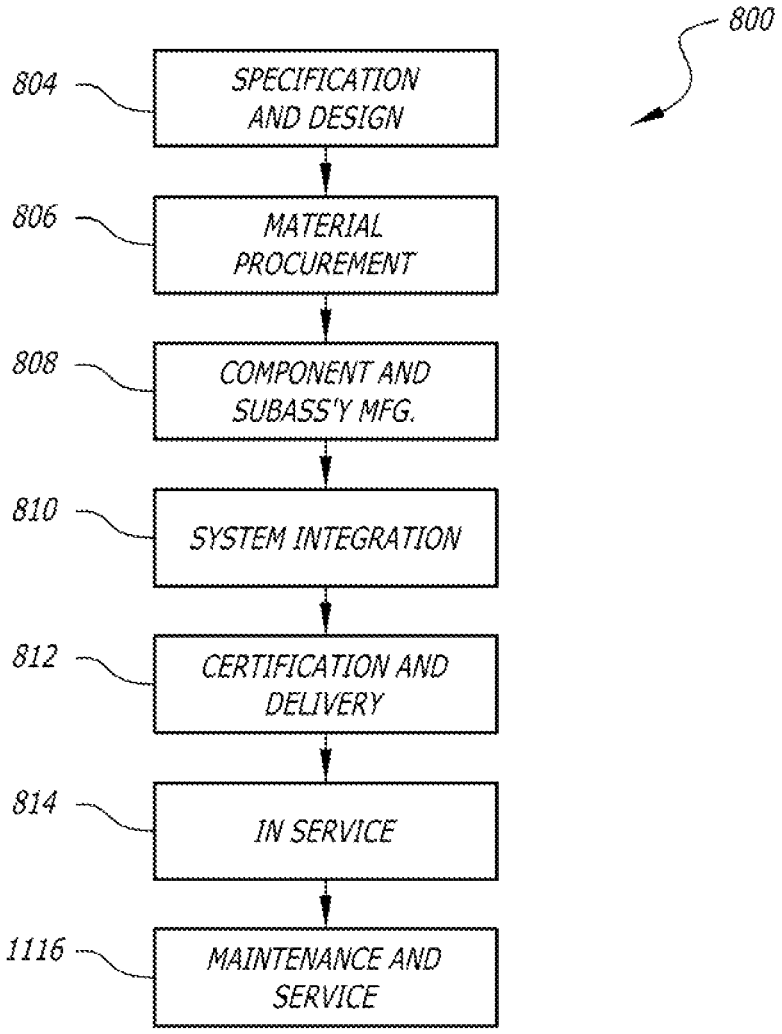

In FIGS. 6-8, referred to above, solid lines, if any, connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the block diagrams may also exist. Dashed lines, if any, connecting blocks designating the various elements and/or components represent couplings similar in function and purpose to those represented by solid lines; however, couplings represented by the dashed lines may either be selectively provided or may relate to alternative or optional examples of the present disclosure. Likewise, elements and/or components, if any, represented with dashed lines, indicate alternative or optional examples of the present disclosure. Environmental elements, if any, are represented with dotted lines. Virtual (imaginary) elements may also be shown for clarity. Those skilled in the art will appreciate that some of the features illustrated in FIGS. 6-8 may be combined in various ways without the need to include other features described in FIGS. 6-8, other drawing figures, and/or the accompanying disclosure, even though such combination or combinations are not explicitly illustrated herein. Similarly, additional features not limited to the examples presented, may be combined with some or all of the features shown and described herein.

In FIGS. 6-8, referred to above, the blocks may represent operations and/or portions thereof and lines connecting the various blocks do not imply any particular order or dependency of the operations or portions thereof. Blocks represented by dashed lines indicate optional operations and/or portions thereof. Dashed lines, if any, connecting the various blocks represent optional dependencies of the operations or portions thereof. It will be understood that not all dependencies among the various disclosed operations are necessarily represented. FIGS. 6-8 and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

In the following description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one example" means that one or more feature, structure, or characteristic described in connection with the example is included in at least one implementation. The phrase "one example" in various places in the specification may or may not be referring to the same example.

Illustrative, non-exhaustive examples, which may or may not be claimed, of the subject matter according the present disclosure are provided below.

Referring generally to e.g., FIGS. 1-5 and specifically to FIG. 6 (block 202), method 200 of forming workpiece 102 made of a naturally aging alloy to a final shape is disclosed. Method 200 comprises providing ISF machine 100 having a coordinate system and a tool path corresponding to the final shape of workpiece 102. Method 200 further comprises performing an initial heat treatment on workpiece 102. Method 200 also comprises positioning workpiece 102 in ISF machine 100 in an initial workpiece orientation in the coordinate system of ISF machine 100. Method 200 further comprises, with workpiece 102 in the initial workpiece orientation in the coordinate system of ISF machine 100 and the tool path of ISF machine 100 in an initial tool-path orientation in the coordinate system of ISF machine 100, performing an initial forming operation on workpiece 102 using ISF machine 100. Method 200 also comprises performing a final heat treatment on workpiece 102. Method 200 further comprises repositioning workpiece 102 in ISF machine 100 in a final workpiece orientation in the coordinate system of ISF machine 100. Method 200 also comprises, with workpiece 102 in the final workpiece orientation in the coordinate system of ISF machine 100 and the tool path of ISF machine 100 in a final tool-path orientation in the coordinate system of ISF machine 100, performing a final forming operation on workpiece 102 using ISF machine 100 to achieve the final shape of workpiece 102. The preceding subject matter of the instant paragraph is in accordance with example 1 of the present disclosure.

The method of example 1 extends the amount of deformation which may be imparted to workpiece 102 by ISF methods, compared to ISF methods limited to one heat treatment.

Figure 1:
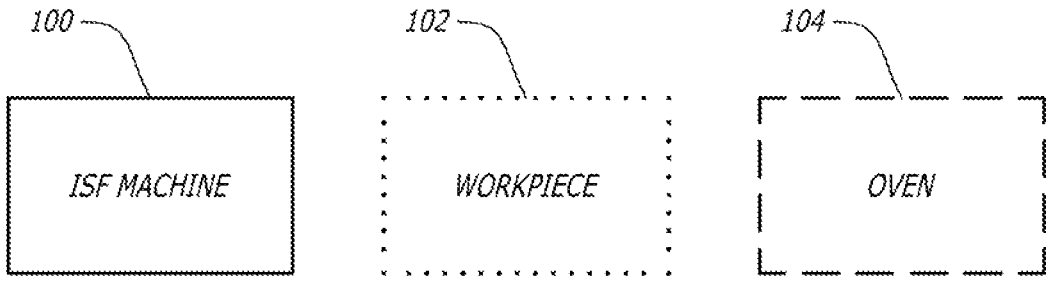

ISF machine 100, shown schematically in FIG. 1, may be any machine made for or adapted to ISF operations. ISF machine 100 may comprise a robot (not shown) operating a hammering tool or a stylus, may include a CNC machine such as a machine tool or lathe adapted to bring a stylus to bear against workpiece 102 (shown schematically in FIG. 1), or may comprise any other powered, automatically controlled machine adapted to bring a hammering tool or stylus to bear against workpiece 102. A stylus may encompass a rolling or rotatable element which contacts workpiece 102, or a domed element which presses against and slides along workpiece 102. ISF machine 100 may be a commercial product such as models DLNC-RA, DLNC-RB, DLNC-PA, DLNC PB, DLNC-PC, and DLNC-PD, commercially available from Amino North America Corporation, 15 Highbury Avenue, St. Thomas, Ontario, Canada N5P 4M1.

ISF machine 100 has computer instructions which instruct the hammer tool or stylus to proceed along a predetermined path such that the hammer tool or stylus impacts workpiece 102 progressively until a desired final shape is achieved. The predetermined path does not necessarily imply that the hammer tool or stylus is limited to only one trajectory. That is, the tool path may vary in that different portions of the predetermined path may be achieved before others. For example, as workpiece 102 is removed from and replaced in ISF machine 100 for heat treatments (e.g., in oven 104, shown schematically in FIG. 1), ISF operations may resume where they were discontinued for removal of workpiece 102, or alternatively, may resume at other locations. Therefore, the tool path will be understood to encompass any tool trajectory which results in achieving the final desired shape of workpiece 102, and should not be read to imply a continuous path.

Also, the tool path is not limited to a single pass over each point of workpiece 102. Where for example a relatively great amount of deformation is to be performed on workpiece 102, two or more passes over those points may be required in successive ISF operations.

The coordinate system of ISF machine 100 may be a virtual coordinate system mapped to specific reference points in three dimensional space established when workpiece 102 is initially placed in ISF machine 100. Sensors (not shown) may record the reference points for subsequent orientation of the tool path as work proceeds.

Heat treatments are those which result in softening workpiece 102 so that workpiece 102 readily deforms under the influence of the hammer tool or stylus. Initial heat treatments are seen as solution annealing in FIG. 2, and as mill annealing in FIGS. 3-5. Solution annealing includes quenching, for example, by immersing workpiece 102 in a water bath (not shown). Mill annealing includes passive or air cooling, before ISF operations commence. Final heat treatments are shown as solution annealing in FIGS. 2-5. FIGS. 2-5 also show intermediate heat treatments, to be described hereinafter. In FIGS. 2-5, an ISF operation follows each heat treatment.

Figure 4:
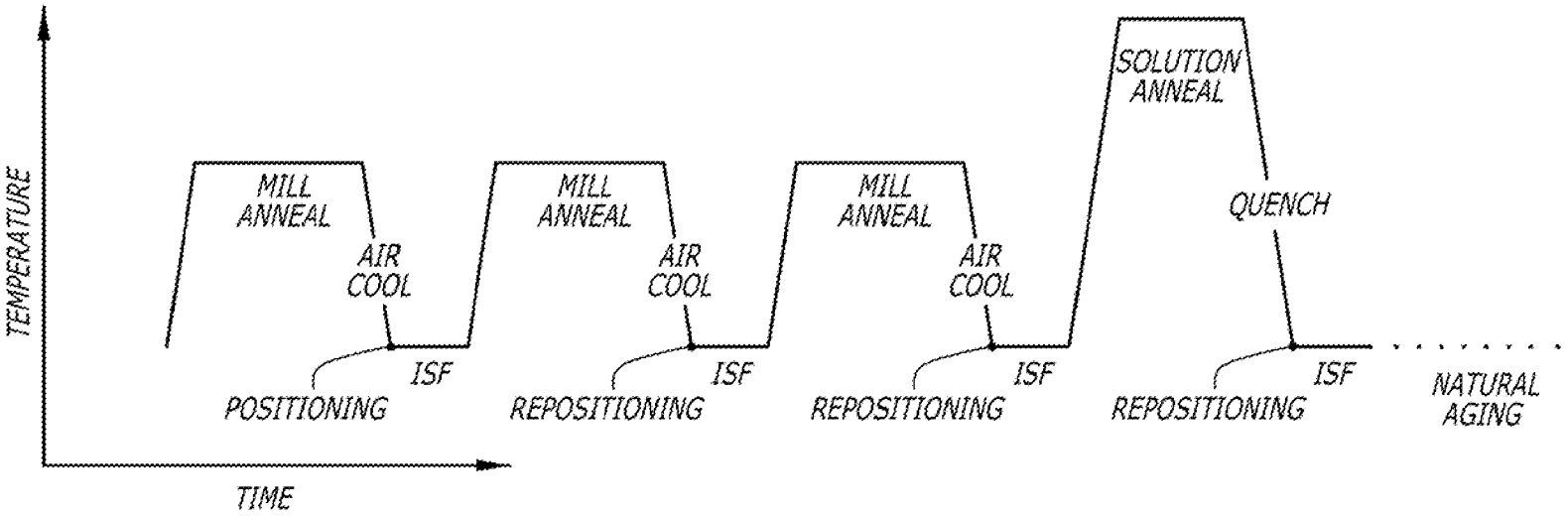
Figure 5:
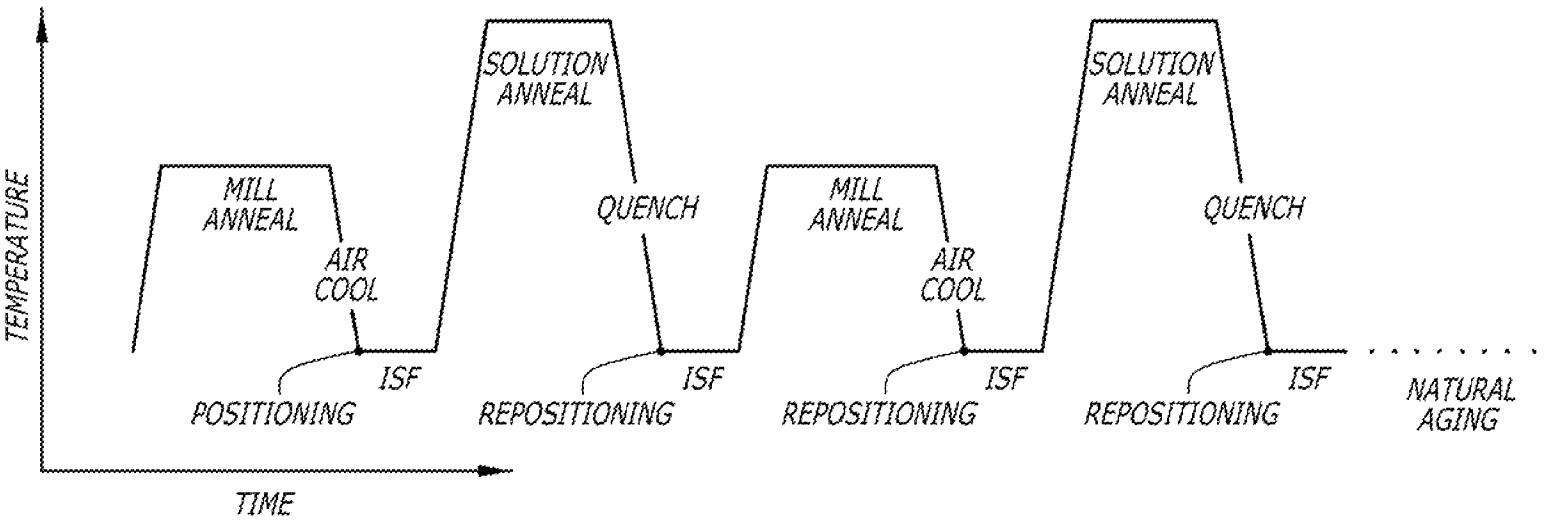
Figure 6A:
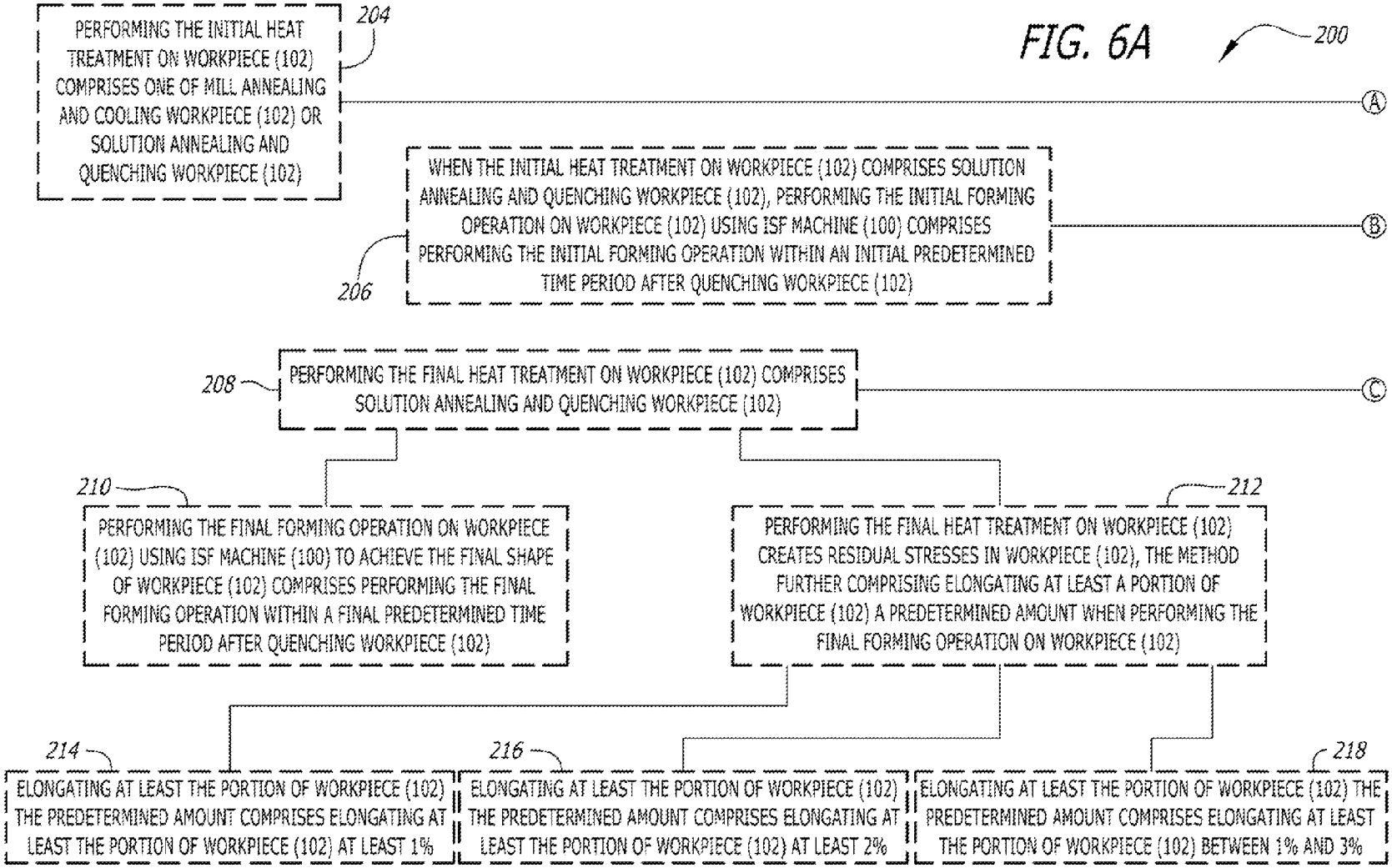

Referring generally to e.g., FIGS. 1-5 and specifically to FIG. 6A (block 204), performing the initial heat treatment on workpiece 102 comprises one of mill annealing and cooling workpiece 102 or solution annealing and quenching workpiece 102. The preceding subject matter of the instant paragraph is in accordance with example 2 of the present disclosure, and example 2 includes the subject matter of example 1, above.

Mill annealing and solution annealing are heat treatments which soften workpiece 102, so that the latter may be readily formed in ISF machine 100.

Mill annealing softens workpiece 102 without causing hardening of workpiece 102 through natural aging. This permits an extended time period to elapse between mill annealing and a subsequent ISF operation. Solution annealing softens workpiece 102 more than mill annealing, although subsequent hardening of workpiece 102 through natural aging will occur. Solution annealing may accommodate deformations by ISF processing that would not be possible with mill annealing. Solution annealing requires bringing the constituent alloy to temperatures close to its melting point. Illustratively, with aluminum alloys, temperatures of 800 or 900 degrees Fahrenheit will satisfy requirements of solution annealing. By contrast, mill annealing may require temperatures of 500 or 600 degrees Fahrenheit. The temperature ranges shown herein are exemplary, and may be extended from the listed values. The disclosed methods may apply also to alloys of magnesium, copper, nickel, titanium, and some stainless steels, in which case temperatures for mill and solution annealing will be different from those applicable to aluminum alloys.

Figure 2:
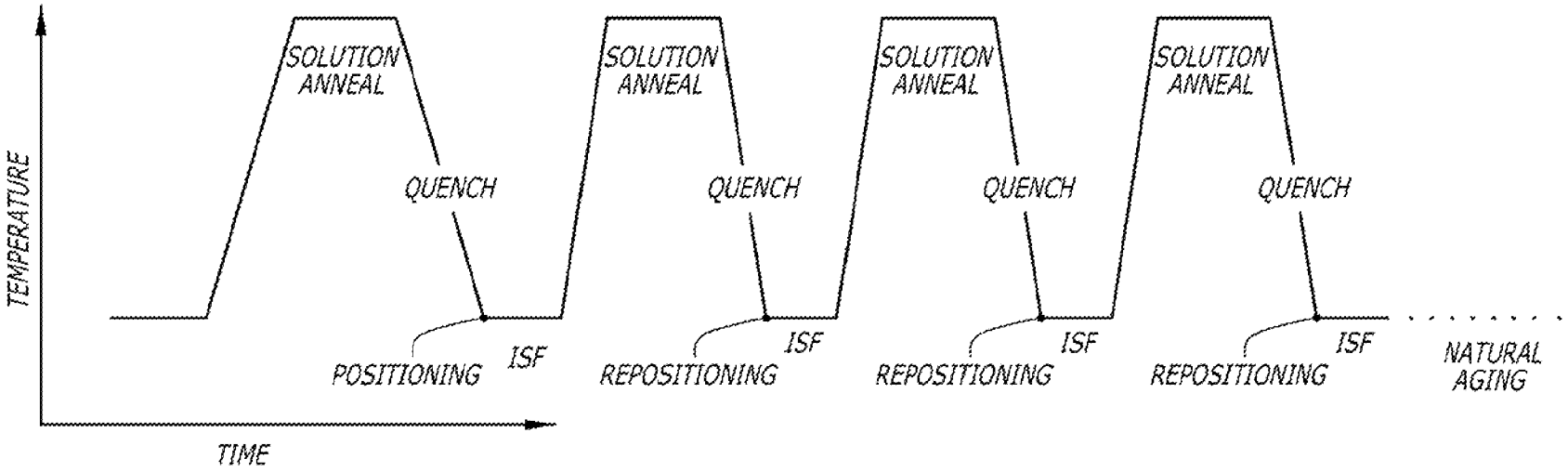

Referring generally to e.g., FIGS. 1 and 2 and specifically to FIG. 6A (block 206), when the initial heat treatment on workpiece 102 comprises solution annealing and quenching workpiece 102, performing the initial forming operation on workpiece 102 using ISF machine 100 comprises performing the initial forming operation within an initial predetermined time period after quenching workpiece 102. The preceding subject matter of the instant paragraph is in accordance with example 3 of the present disclosure, and example 3 includes the subject matter of example 1, above.

Performing the initial forming operation within the initial predetermined time period enables workpiece 102 to be worked before hardening due to natural aging resists further deformation in the forming process, or alternatively, results in damage to ISF machine 100.

Referring generally to e.g., FIGS. 1 and 2 and specifically to FIG. 6, the initial predetermined time period is no more than one hour. The preceding subject matter of the instant paragraph is in accordance with example 4 of the present disclosure, and example 4 includes the subject matter of example 3, above.

Limiting the initial predetermined time period to an hour accommodates working of some alloys which can be worked for up to an hour before hardening due to natural aging interferes with ISF processing. Aluminum alloy 2024 is an example of an alloy which can be worked for up to, but preferably not more than, an hour.

Referring generally to e.g., FIGS. 1 and 2 and specifically to FIG. 6, the initial predetermined time period is no more than one half hour. The preceding subject matter of the instant paragraph is in accordance with example 5 of the present disclosure, and example 5 includes the subject matter of example 3, above.

Limiting the initial predetermined time period to one half hour accommodates working of those alloys which can be worked for up to one half hour before hardening due to natural aging interferes with ISF processing. Aluminum alloy 2024 is an example of an alloy which can be worked for up to, but preferably not more than, half an hour.

Referring generally to e.g., FIGS. 1-5 and specifically to FIG. 6A (block 208), performing the final heat treatment on workpiece 102 comprises solution annealing and quenching workpiece 102. The preceding subject matter of the instant paragraph is in accordance with example 6 of the present disclosure, and example 6 includes the subject matter of any of examples 1-5, above.

When the final heat treatment comprises solution annealing and quenching, workpiece 102 will eventually attain its maximal strength due to hardening while naturally aging. This would not occur with mill annealing.

Referring generally to e.g., FIGS. 1-5 and specifically to FIG. 6A (block 210), performing the final forming operation on workpiece 102 using ISF machine 100 to achieve the final shape of workpiece 102 comprises performing the final forming operation within a final predetermined time period after quenching workpiece 102. The preceding subject matter of the instant paragraph is in accordance with example 7 of the present disclosure, and example 7 includes the subject matter of example 6, above.

Performing the final forming operation within the final predetermined time period after quenching accommodates working of those alloys which harden due to natural aging, which would interfere with ISF processing, as described above.

Referring generally to e.g., FIGS. 1-5 and specifically to FIG. 6, the final predetermined time period is no more than one hour. The preceding subject matter of the instant paragraph is in accordance with example 8 of the present disclosure, and example 8 includes the subject matter of example 7, above.

Limiting the final predetermined time period to an hour accommodates working of some alloys which can be worked for up to an hour before hardening due to natural aging interferes with ISF processing, as described above. Aluminum alloy 2024 is an example of an alloy which can be worked for up to, but preferably not more than, an hour.

Referring generally to e.g., FIGS. 1-5 and specifically to FIG. 6, the final predetermined time period is no more than one half hour. The preceding subject matter of the instant paragraph is in accordance with example 9 of the present disclosure, and example 9 includes the subject matter of example 7, above.

Limiting the final predetermined time period to one half hour accommodates working of those alloys which can be worked for up to one half hour before hardening due to natural aging interferes with ISF processing. Aluminum alloy 2024 is an example of an alloy which can be worked for up to, but preferably not more than, a half hour.

Referring generally to e.g., FIGS. 1-5 and specifically to FIG. 6A (block 212), performing the final heat treatment on workpiece 102 creates residual stresses in workpiece 102. Method 200 further comprises elongating at least a portion of workpiece 102 a predetermined amount when performing the final forming operation on workpiece 102. The preceding subject matter of the instant paragraph is in accordance with example 10 of the present disclosure, and example 10 includes the subject matter of any of examples 6-9, above.

Elongating workpiece 102 the predetermined amount relieves the residual stresses and avoids resultant deformation of workpiece 102. Elongating workpiece 102 is not a discrete step unto itself; rather, ISF operations are arranged such that they result in, at a minimum, the predetermined amount of elongation.

Referring generally to e.g., FIGS. 1-5 and specifically to FIG. 6A (block 214), elongating at least the portion of workpiece 102 the predetermined amount comprises elongating at least the portion of workpiece 102 at least 1%. The preceding subject matter of the instant paragraph is in accordance with example 11 of the present disclosure, and example 11 includes the subject matter of example 10, above.

Elongating workpiece 102 at least 1% relieves the residual stresses in some alloys.

Referring generally to e.g., FIGS. 1-5 and specifically to FIG. 6A (block 216), elongating at least the portion of workpiece 102 the predetermined amount comprises elongating at least the portion of workpiece 102 at least 2%. The preceding subject matter of the instant paragraph is in accordance with example 12 of the present disclosure, and example 12 includes the subject matter of example 10, above.

Elongating workpiece 102 at least 2% relieves the residual stresses in some alloys wherein residual stresses would not be relieved by, for example, 1% elongation.

Referring generally to e.g., FIGS. 1-5 and specifically to FIG. 6A (block 218), elongating at least the portion of workpiece 102 the predetermined amount comprises elongating at least the portion of workpiece 102 between 1% and 3%. The preceding subject matter of the instant paragraph is in accordance with example 13 of the present disclosure, and example 13 includes the subject matter of example 10, above.

Elongating workpiece 102 between 1% and 3% relieves residual stresses in many if not most aluminum alloys.

Figure 6B:
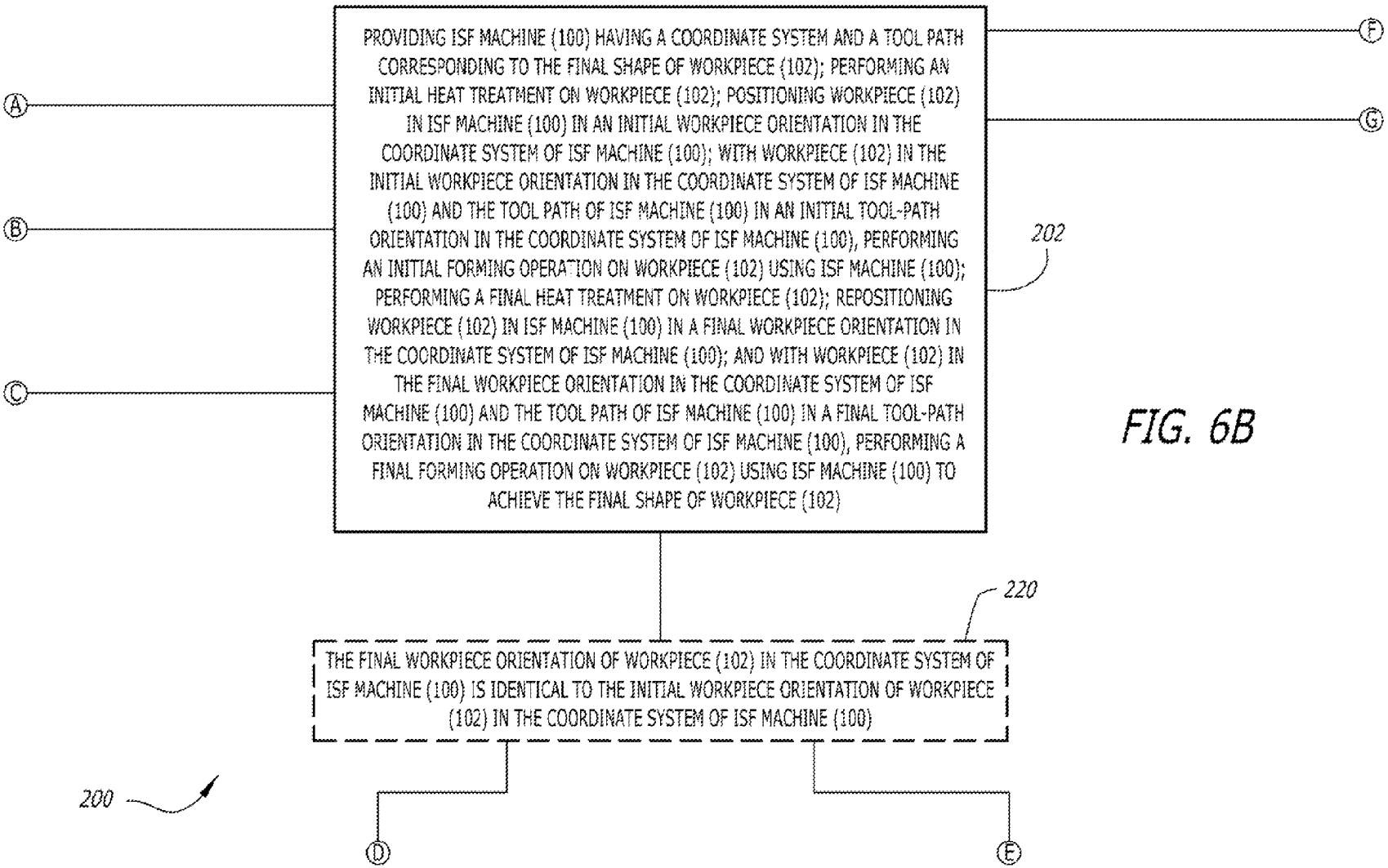

Referring generally to e.g., FIGS. 1-5 and specifically to FIG. 6B (block 220), the final workpiece orientation of workpiece 102 in the coordinate system of ISF machine 100 is identical to the initial workpiece orientation of workpiece 102 in the coordinate system of ISF machine 100. The preceding subject matter of the instant paragraph is in accordance with example 14 of the present disclosure, and example 14 includes the subject matter of any of examples 1-13, above.

Identical initial and final workpiece orientations enable ISF operations to proceed seamlessly after being interrupted for a subsequent heat treatment after the initial forming operation. That is, replacement of workpiece 102 in ISF machine 100 in an identical workpiece orientation following a heat treatment after the initial forming operation will not introduce a distortion of the tool path at the point of resuming ISF operations, which distortion could arise if the completed portion and the uncompleted portion of the tool path were not appropriately aligned.

Workpiece 102 may be replaced in ISF machine 100 in different ways. When this is done manually for example, it may be possible that the final workpiece orientation will not match the initial workpiece orientation. Identical initial and final workpiece orientations reduce requirements that ISF machine 100 be capable of machine compensating for different initial and final workpiece orientations.

Figure 6C:
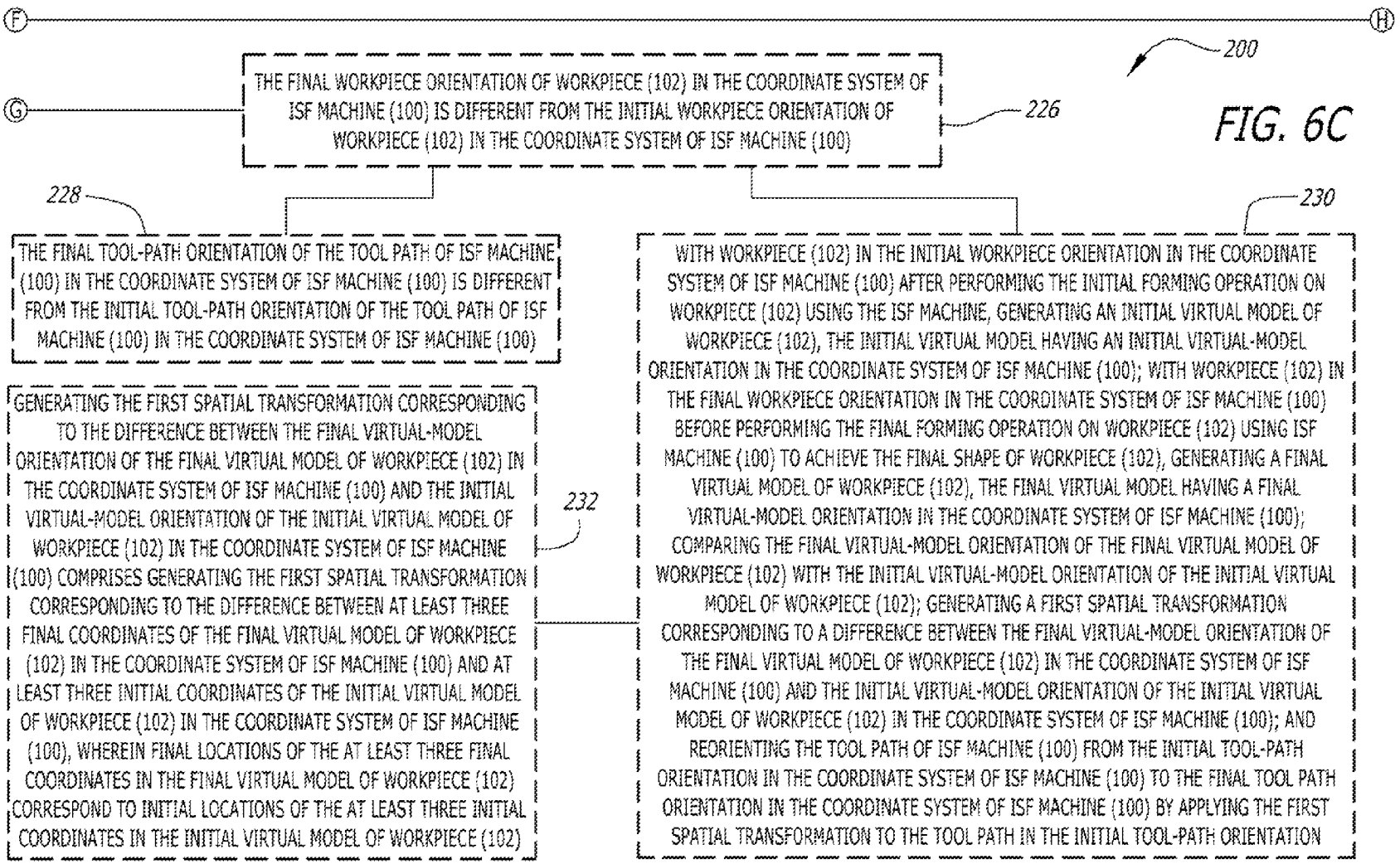
Figure 6D:
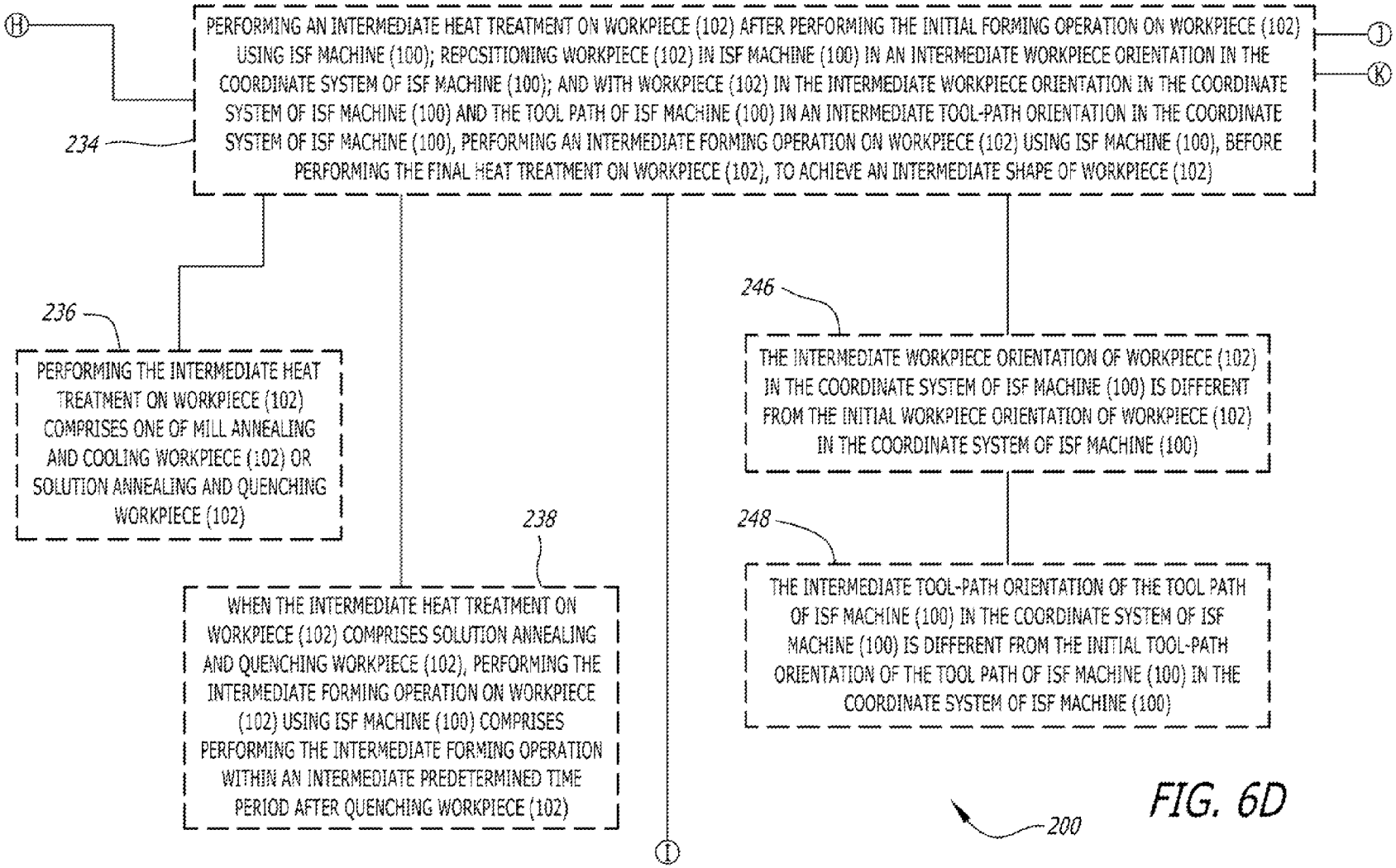
Figure 6E:
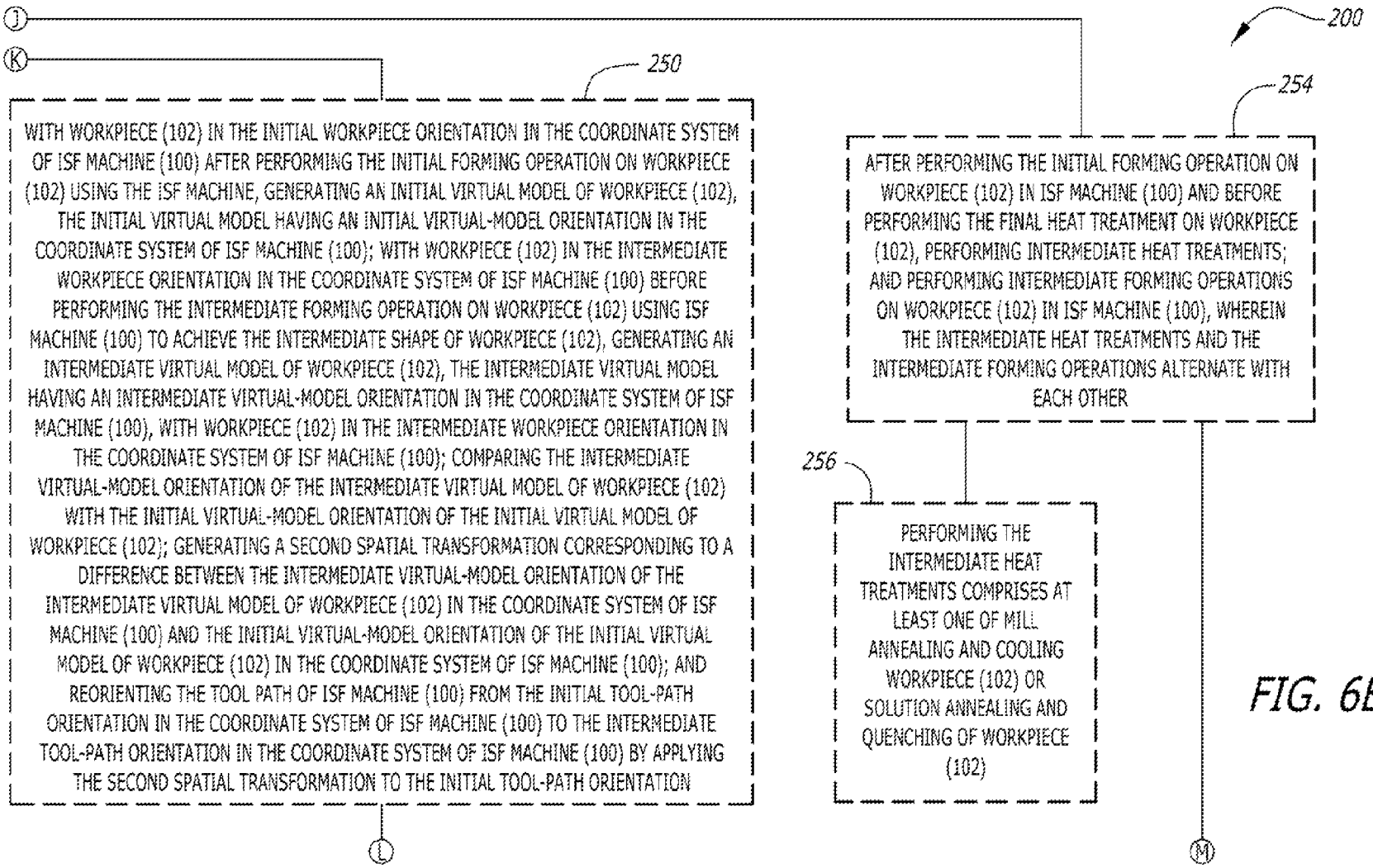
Figure 6F:
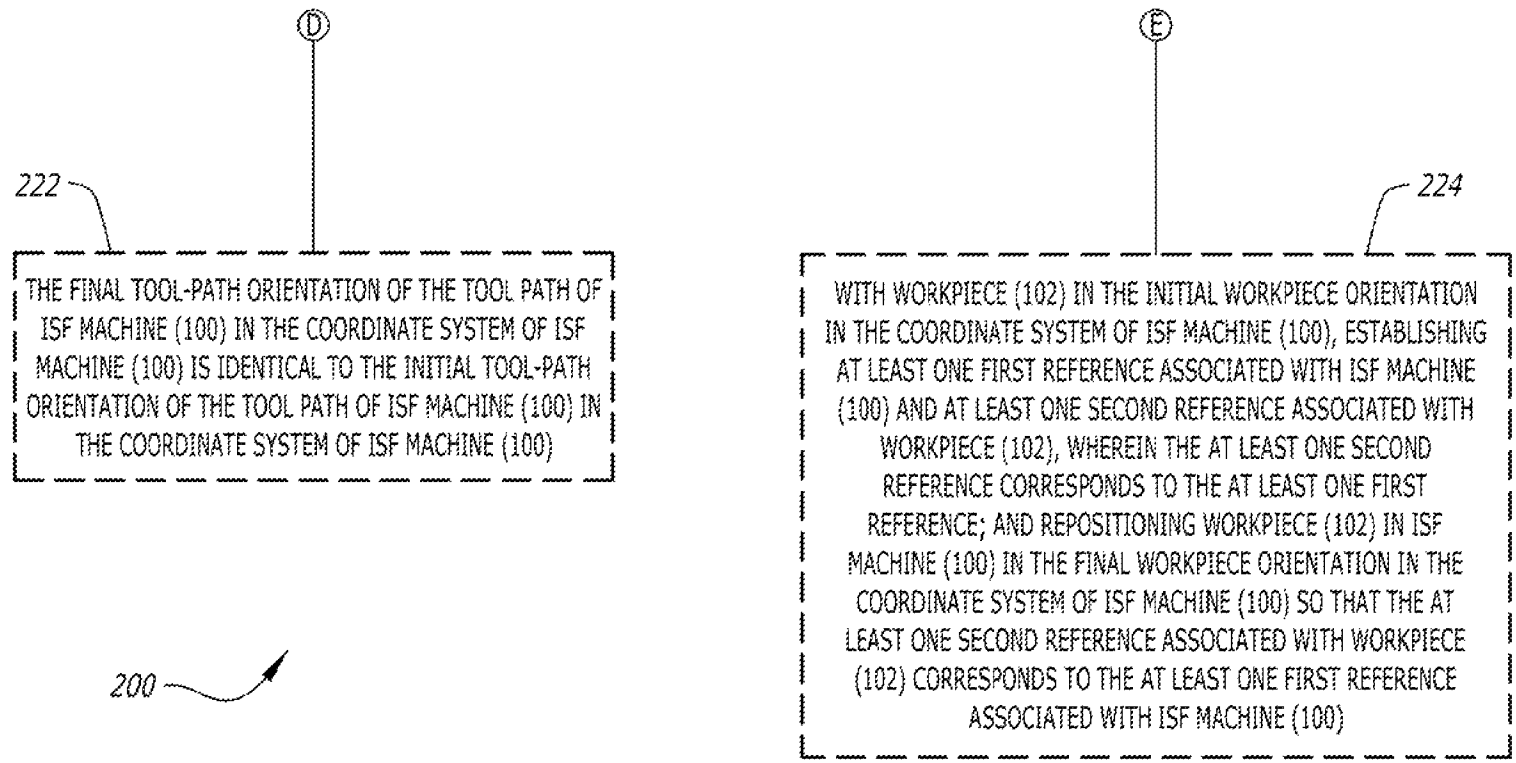

Referring generally to e.g., FIGS. 1-5 and specifically to FIG. 6F (block 222), the final tool-path orientation of the tool path of ISF machine 100 in the coordinate system of ISF machine 100 is identical to the initial tool-path orientation of the tool path of ISF machine 100 in the coordinate system of ISF machine 100. The preceding subject matter of the instant paragraph is in accordance with example 15 of the present disclosure, and example 15 includes the subject matter of example 14, above.

Identical final tool-path orientation relative to the initial tool-path orientation assures seamless continuity of a subsequent ISF operation, thereby achieving the intended final shape of workpiece 102. With identical initial and final tool-path orientations, ISF machine 100 may resume ISF operations without being obliged to compensate for misalignment of the uncompleted portion of the tool path with the completed portion.

Referring generally to e.g., FIGS. 1-5 and specifically to FIG. 6F (block 224), method 200 further comprises, with workpiece 102 in the initial workpiece orientation in the coordinate system of ISF machine 100, establishing at least one first reference associated with ISF machine 100 and at least one second reference associated with workpiece 102. The at least one second reference corresponds to the at least one first reference. Method 200 also comprises repositioning workpiece 102 in ISF machine 100 in the final workpiece orientation in the coordinate system of ISF machine 100 so that the at least one second reference associated with workpiece 102 corresponds to the at least one first reference associated with ISF machine 100. The preceding subject matter of the instant paragraph is in accordance with example 16 of the present disclosure, and example 16 includes the subject matter of any of examples 14 and 15, above.

Corresponding references on ISF machine 100 and workpiece 102 enable the latter to be replaced in ISF machine 100 after a heat treatment in a position such that subsequent ISF operations result in seamlessly resuming the intended tool path of ISF machine 100. Placement of workpiece 102 in the ISF machine may be manually performed.

References may be obtained in a number of ways. For example, a sensor (not shown) may identify predetermined points on workpiece 102, and record these relative to the coordinate system of ISF machine 100. Alternatively, optical scanning may be used to map predetermined or machine identified points on workpiece 102 to reference points of ISF machine 100. References may also be manually determined by the operator of ISF machine 100. Location of an edge of or a point on workpiece 102 may be measured from an arbitrary point on a workpiece support surface (not shown) of ISF machine 100, with measured values being replicated when workpiece 102 is replaced in ISF machine 100 following a heat treatment, for example.

Referring generally to e.g., FIGS. 1-5 and specifically to FIG. 6C (block 226), the final workpiece orientation of workpiece 102 in the coordinate system of ISF machine 100 is different from the initial workpiece orientation of workpiece 102 in the coordinate system of ISF machine 100. The preceding subject matter of the instant paragraph is in accordance with example 17 of the present disclosure, and example 17 includes the subject matter of any of examples 1-13, above.

If not required to be oriented identically within the coordinate system of ISF machine 100, replacement of workpiece 102 within ISF machine 100 can be performed more expeditiously, hence leaving more time for ISF operations before hardening due to natural aging limits the ISF process.

Different initial and final orientations of workpiece 102 may arise, for example, when workpiece 102 is manually replaced in ISF machine 100 following heat treatment(s).

Referring generally to e.g., FIGS. 1-5 and specifically to FIG. 6C (block 228), the final tool-path orientation of the tool path of ISF machine 100 in the coordinate system of ISF machine 100 is different from the initial tool-path orientation of the tool path of ISF machine 100 in the coordinate system of ISF machine 100. The preceding subject matter of the instant paragraph is in accordance with example 18 of the present disclosure, and example 18 includes the subject matter of example 17, above.

A different final tool-path orientation accommodates replacement of workpiece 102 in ISF machine 100 in a new orientation such that, where the previous tool path is not replicated, subsequent ISF operations result in seamlessly resuming or continuing the intended tool path of ISF machine 100 relative to workpiece 102. Different initial and final orientations of the tool path may arise, for example, when workpiece 102 is manually replaced in ISF machine 100 following heat treatment(s).

Resumption of the tool path may include machine compensation for the different final tool-path orientation, so that the hypothetical tool path is not affected by the different final tool-path orientation.

Referring generally to e.g., FIGS. 1-5 and specifically to FIG. 6C (block 230), method 200 further comprises, with workpiece 102 in the initial workpiece orientation in the coordinate system of ISF machine 100 after performing the initial forming operation on workpiece 102 using ISF machine 100, generating an initial virtual model of workpiece 102, the initial virtual model having an initial virtual-model orientation in the coordinate system of ISF machine 100. Method 200 also comprises, with workpiece 102 in the final workpiece orientation in the coordinate system of ISF machine 100 before performing the final forming operation on workpiece 102 using ISF machine 100 to achieve the final shape of workpiece 102, generating a final virtual model of workpiece 102, the final virtual model having a final virtual-model orientation in the coordinate system of ISF machine 100. Method 200 further comprises comparing the final virtual-model orientation of the final virtual model of workpiece 102 with the initial virtual-model orientation of the initial virtual model of workpiece 102. Method 200 also comprises generating a first spatial transformation corresponding to a difference between the final virtual-model orientation of the final virtual model of workpiece 102 in the coordinate system of ISF machine 100 and the initial virtual-model orientation of the initial virtual model of workpiece 102 in the coordinate system of ISF machine 100. Method 200 further comprises reorienting the tool path of ISF machine 100 from the initial tool-path orientation in the coordinate system of ISF machine 100 to the final tool path orientation in the coordinate system of ISF machine 100 by applying the first spatial transformation to the tool path in the initial tool-path orientation. The preceding subject matter of the instant paragraph is in accordance with example 19 of the present disclosure, and example 19 includes the subject matter of any of examples 17 and 18, above.

Reorienting the tool path of ISF machine 100 from the initial tool-path orientation results in seamlessly resuming or completing the intended tool path of ISF machine 100 relative to workpiece 102 even when workpiece 102 has been repositioned in a new orientation in ISF machine 100 following a heat treatment.

The initial and final virtual models allow selected points of each to be identified and compared for subsequent adjustment of the trajectory of the tool path upon resumption of ISF operations.

Referring generally to e.g., FIGS. 1-5 and specifically to FIG. 6C (block 232), generating the first spatial transformation corresponding to the difference between the final virtual-model orientation of the final virtual model of workpiece 102 in the coordinate system of ISF machine 100 and the initial virtual-model orientation of the initial virtual model of workpiece 102 in the coordinate system of ISF machine 100 comprises generating the first spatial transformation corresponding to the difference between at least three final coordinates of the final virtual model of workpiece 102 in the coordinate system of ISF machine 100 and at least three initial coordinates of the initial virtual model of workpiece 102 in the coordinate system of ISF machine 100. Final locations of the at least three final coordinates in the final virtual model of workpiece 102 correspond to initial locations of the at least three initial coordinates in the initial virtual model of workpiece 102. The preceding subject matter of the instant paragraph is in accordance with example 20 of the present disclosure, and example 20 includes the subject matter of example 19, above.

Appropriate adjustment of an uncompleted portion of the tool path relative to a completed portion can be based on sensing position of workpiece 102, based on the at least three initial and final coordinates, in ISF machine 100.

The at least three coordinates of the initial and final virtual models of workpiece 102 correspond to the selected points to be identified and compared.

Referring generally to e.g., FIGS. 1-5 and specifically to FIG. 6D (block 234), method 200 further comprises performing an intermediate heat treatment on workpiece 102 after performing the initial forming operation on workpiece 102 using ISF machine 100. Method 200 also comprises repositioning workpiece 102 in ISF machine 100 in an intermediate workpiece orientation in the coordinate system of ISF machine 100. Method 200 further comprises, with workpiece 102 in the intermediate workpiece orientation in the coordinate system of ISF machine 100 and the tool path of ISF machine 100 in an intermediate tool-path orientation in the coordinate system of ISF machine 100, performing an intermediate forming operation on workpiece 102 using ISF machine 100, before performing the final heat treatment on workpiece 102, to achieve an intermediate shape of workpiece 102. The preceding subject matter of the instant paragraph is in accordance with example 21 of the present disclosure, and example 21 includes the subject matter of any of examples 1-20, above.

An intermediate heat treatment enables extended ISF operations to be conducted on workpiece 102, thereby enabling workpiece 102, even if large or complicated, to be successfully formed by the ISF process.

Referring generally to e.g., FIGS. 1-5 and specifically to FIG. 6D (block 236), performing the intermediate heat treatment on workpiece 102 comprises one of mill annealing and cooling workpiece 102 or solution annealing and quenching workpiece 102. The preceding subject matter of the instant paragraph is in accordance with example 22 of the present disclosure, and example 22 includes the subject matter of example 21, above.

Mill annealing and solution annealing are heat treatments which soften workpiece 102, so that the latter will be readily formed in subsequent ISF operations.

Referring generally to e.g., FIGS. 1, 2, and 5, and specifically to FIG. 6D (block 238), when the intermediate heat treatment on workpiece 102 comprises solution annealing and quenching workpiece 102, performing the intermediate forming operation on workpiece 102 using ISF machine 100 comprises performing the intermediate forming operation within an intermediate predetermined time period after quenching workpiece 102. The preceding subject matter of the instant paragraph is in accordance with example 23 of the present disclosure, and example 23 includes the subject matter of example 21, above.

Performing the intermediate forming operation within the intermediate predetermined time period after solution annealing and quenching enables those alloys which harden due to natural aging to be worked by ISF processing before hardening interferes with ISF processing.

Referring generally to e.g., FIGS. 1-3 and 5, and specifically to FIG. 6, the intermediate predetermined time period is no more than one hour. The preceding subject matter of the instant paragraph is in accordance with example 24 of the present disclosure, and example 24 includes the subject matter of example 23, above.

Limiting the intermediate predetermined time period to an hour accommodates working of those alloys which can be worked for up to an hour before hardening due to natural aging interferes with ISF processing.

Referring generally to e.g., FIGS. 1-3 and 5, and specifically to FIG. 6, the intermediate predetermined time period is no more than one half hour. The preceding subject matter of the instant paragraph is in accordance with example 25 of the present disclosure, and example 25 includes the subject matter of example 23, above.

Limiting the intermediate predetermined time period to an hour accommodates working of those alloys which can be worked for up to a half hour before hardening due to natural aging interferes with ISF processing.

Referring generally to e.g., FIGS. 1-5 and specifically to FIG. 6 (block 240), the intermediate workpiece orientation of workpiece 102 in the coordinate system of ISF machine 100 is identical to the initial workpiece orientation of workpiece 102 in the coordinate system of ISF machine 100. The preceding subject matter of the instant paragraph is in accordance with example 26 of the present disclosure, and example 26 includes the subject matter of any of examples 21-25, above.

Identical initial and intermediate workpiece orientations enable ISF operations to proceed seamlessly, without distortion of the tool path, after being interrupted for a subsequent heat treatment after the initial forming operation.

Referring generally to e.g., FIGS. 1-5 and specifically to FIG. 6 (block 242), the intermediate tool-path orientation of the tool path of ISF machine 100 in the coordinate system of ISF machine 100 is identical to the initial tool-path orientation of the tool path of ISF machine 100 in the coordinate system of ISF machine 100. The preceding subject matter of the instant paragraph is in accordance with example 27 of the present disclosure, and example 27 includes the subject matter of example 26, above.

Identical intermediate tool-path orientation relative to the initial tool-path orientation assures seamless continuity of a subsequent ISF operation, thereby achieving the intended final shape of workpiece 102. With identical initial and final tool-path orientations, ISF machine 100 can resume ISF operations without being obliged to compensate for misalignment of the uncompleted portion of the tool path with the completed portion.

Referring generally to e.g., FIGS. 1-5 and specifically to FIG. 6 (block 244), method 200 further comprises, with workpiece 102 in the initial workpiece orientation in the coordinate system of ISF machine 100, establishing at least one third reference associated with ISF machine 100 and at least one fourth reference associated with workpiece 102. The at least one fourth reference corresponds to the at least one third reference. Method 200 also comprises repositioning workpiece 102 in ISF machine 100 in the intermediate workpiece orientation in the coordinate system of ISF machine 100 so that the at least one fourth reference associated with workpiece 102 corresponds to the at least one third reference associated with ISF machine 100. The preceding subject matter of the instant paragraph is in accordance with example 28 of the present disclosure, and example 28 includes the subject matter of any of examples 26 and 27, above.

This minimizes effort of replacing workpiece 102 in ISF machine 100 following a heat treatment, thereby conserving time which may then be utilized for ISF operations before workpiece 102 hardens due to natural aging.

The third and fourth references may correspond in nature to the first and second references described above.

Figure 6G:
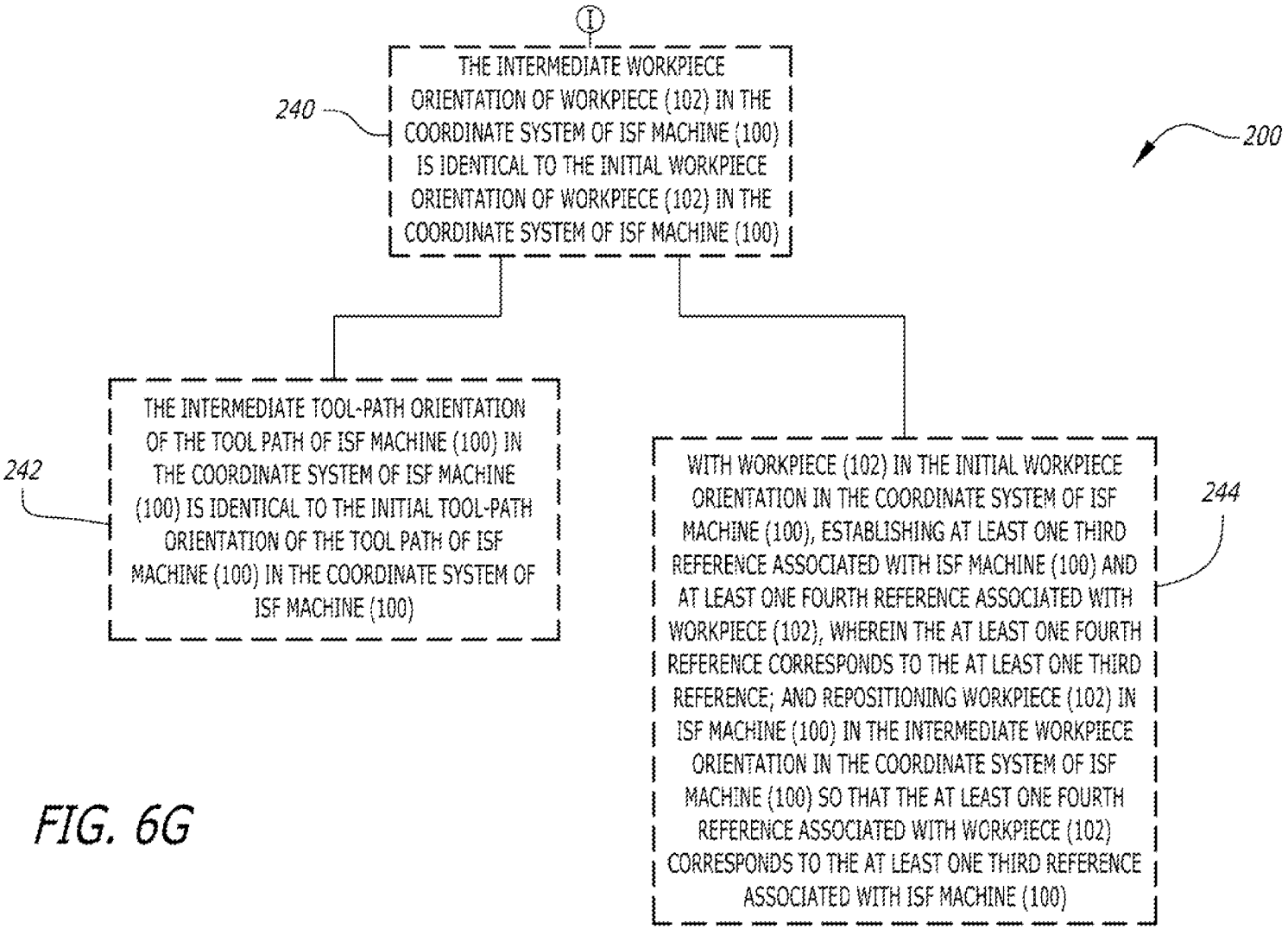

Referring generally to e.g., FIGS. 1-5 and specifically to FIG. 6G (block 246), the intermediate workpiece orientation of workpiece 102 in the coordinate system of ISF machine 100 is different from the initial workpiece orientation of workpiece 102 in the coordinate system of ISF machine 100. The preceding subject matter of the instant paragraph is in accordance with example 29 of the present disclosure, and example 29 includes the subject matter of any of examples 21-25, above.

This minimizes demands on accuracy and hence time when replacing workpiece 102 in ISF machine 100. Different initial and intermediate orientations of workpiece 102 may arise, for example, when workpiece 102 is manually replaced in ISF machine 100 following heat treatment(s) in a new position.

Referring generally to e.g., FIGS. 1-5 and specifically to FIG. 6D (block 248), the intermediate tool-path orientation of the tool path of ISF machine 100 in the coordinate system of ISF machine 100 is different from the initial tool-path orientation of the tool path of ISF machine 100 in the coordinate system of ISF machine 100. The preceding subject matter of the instant paragraph is in accordance with example 30 of the present disclosure, and example 30 includes the subject matter of example 29, above.

If not required to be oriented identically within the coordinate system of ISF machine 100, replacement of workpiece 102 within ISF machine 100 can be performed more expeditiously, hence leaving more time for ISF operations before hardening due to natural aging limits the ISF process. Different initial and final tool-path orientations may arise, for example, when workpiece 102 is manually replaced in a new position in ISF machine 100 following heat treatment(s).

Referring generally to e.g., FIGS. 1-5 and specifically to FIG. 6E (block 250), method 200 further comprises, with workpiece 102 in the initial workpiece orientation in the coordinate system of ISF machine 100 after performing the initial forming operation on workpiece 102 using ISF machine, generating an initial virtual model of workpiece 102. The initial virtual model has an initial virtual-model orientation in the coordinate system of ISF machine 100. Method 200 also comprises, with workpiece 102 in the intermediate workpiece orientation in the coordinate system of ISF machine 100 before performing the intermediate forming operation on workpiece 102 using ISF machine 100 to achieve the intermediate shape of workpiece 102, generating an intermediate virtual model of workpiece 102. The intermediate virtual model has an intermediate virtual-model orientation in the coordinate system of ISF machine 100, with workpiece 102 in the intermediate workpiece orientation in the coordinate system of ISF machine 100.

Method 200 further comprises comparing the intermediate virtual-model orientation of the intermediate virtual model of workpiece 102 with the initial virtual-model orientation of the initial virtual model of workpiece 102. Method 200 also comprises generating a second spatial transformation corresponding to a difference between the intermediate virtual-model orientation of the intermediate virtual model of workpiece 102 in the coordinate system of ISF machine 100 and the initial virtual-model orientation of the initial virtual model of workpiece 102 in the coordinate system of ISF machine 100. Method 200 further comprises reorienting the tool path of ISF machine 100 from the initial tool-path orientation in the coordinate system of ISF machine 100 to the intermediate tool-path orientation in the coordinate system of ISF machine 100 by applying the second spatial transformation to the initial tool-path orientation. The preceding subject matter of the instant paragraph is in accordance with example 31 of the present disclosure, and example 31 includes the subject matter of any of examples 29 and 30, above.

Reorienting the tool path of ISF machine 100 from the initial tool-path orientation, based on the initial and intermediate virtual models, results in seamlessly resuming the intended tool path of ISF machine 100 relative to workpiece 102 even when workpiece 102 has been repositioned in a new orientation in ISF machine 100 following a heat treatment.

Referring generally to e.g., FIGS. 1-5 and specifically to FIG. 6H (block 252), generating the second spatial transformation corresponding to the difference between the intermediate virtual-model orientation of the intermediate virtual model of workpiece 102 in the coordinate system of ISF machine 100 and the initial virtual-model orientation of the initial virtual model of workpiece 102 in the coordinate system of ISF machine 100 comprises generating the second spatial transformation corresponding to the difference between at least three intermediate coordinates of the intermediate virtual model of workpiece 102 in the coordinate system of ISF machine 100 and at least three initial coordinates of the initial virtual model of workpiece 102 in the coordinate system of ISF machine 100. Intermediate locations of the at least three intermediate coordinates in the intermediate virtual model of workpiece 102 correspond to initial locations of the at least three initial coordinates in the initial virtual model of workpiece 102. The preceding subject matter of the instant paragraph is in accordance with example 32 of the present disclosure, and example 32 includes the subject matter of example 31, above.

This permits appropriate adjustment of an uncompleted portion of the tool path to be based on sensing position of workpiece 102 in ISF machine 100.

Referring generally to e.g., FIGS. 1-5 and specifically to FIG. 6E (block 254), method 200 further comprises, after performing the initial forming operation on workpiece 102 in ISF machine 100 and before performing the final heat treatment on workpiece 102, performing intermediate heat treatments. Method 200 also comprises performing intermediate forming operations on workpiece 102 in ISF machine 100. The intermediate heat treatments and the intermediate forming operations alternate with each other. The preceding subject matter of the instant paragraph is in accordance with example 33 of the present disclosure, and example 33 includes the subject matter of any of examples 1-20, above.

Intermediate heat treatments enable extended ISF operations to be conducted on workpiece 102, thereby enabling workpiece 102, even if large or complicated, to be successfully formed by the ISF process.

Figure 3:
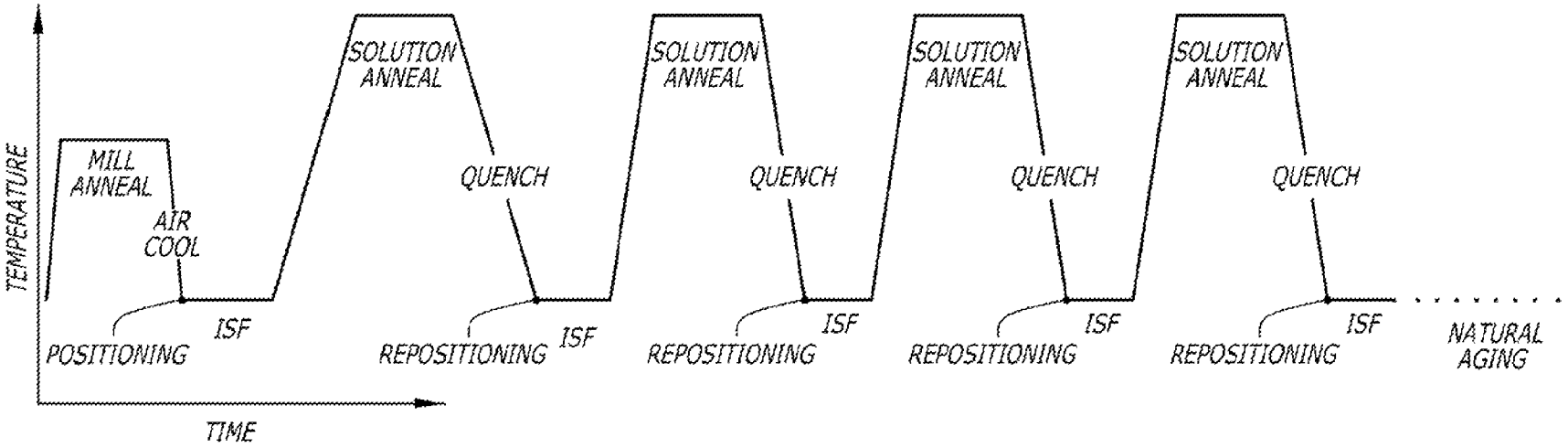

An intermediate heat treatment occurs after the initial ISF forming operation and before the final heat treatment. In FIGS. 2-5, there are two intermediate heat treatments, each including a cooling step of either quenching if the heat treatment is solution annealing (FIGS. 2, 3, and 5), or, if the heat treatment is mill annealing, air cooling (FIGS. 4 and 5), followed by repositioning of workpiece 102 in ISF machine 100. FIG. 2 depicts four total heat treatments and ISF operations. FIGS. 3-5 depict five total heat treatments and ISF operations. With aluminum alloys, three to six heat treatments and ISF operations are feasible.

In FIG. 2, all of the heat treatments are solution annealing. This maximizes softness of workpiece 102, thereby permitting the greatest amount of deformation when conducting ISF operations. FIG. 3 shows an initial mill annealing heat treatment, wherein all subsequent heat treatments are solution annealing. Time from fabrication of the sheet stock which subsequently becomes workpiece 102 to the first ISF operation is not limited when the heat treatment is mill annealing. Consequently, the initial mill annealing may be conducted either at the ISF facility or at the facility preparing the sheet stock.

FIG. 4 shows a process wherein all of the heat treatments except the final heat treatment are mill annealing. The process of FIG. 4 allows for maximally extended working times in ISF forming operations before hardening due to natural aging forces discontinuation of ISF operations.

FIG. 5 shows a mix of mill annealing and solution annealing. This option enables a mix of lengthy or extended working times in ISF forming operations with some ISF forming operations providing relatively great deformation of workpiece 102.

The examples of FIGS. 2-5 may utilize method 200, or alternatively, in the case of FIGS. 3-5, may utilize method 300, to be described hereinafter.

Referring generally to e.g., FIGS. 1-5 and specifically to FIG. 6E (block 256), performing the intermediate heat treatments comprises at least one of mill annealing and cooling the workpiece 102 or solution annealing and quenching of workpiece 102. The preceding subject matter of the instant paragraph is in accordance with example 34 of the present disclosure, and example 34 includes the subject matter of example 33, above.

Mill annealing and solution annealing are heat treatments which soften workpiece 102, so that the latter can be successfully formed by subsequent ISF operations.

Referring generally to e.g., FIGS. 1-5 and specifically to FIG. 6H (block 258), when the intermediate heat treatments on workpiece 102 comprises solution annealing and quenching workpiece 102, performing the intermediate forming operations on workpiece 102 using ISF machine 100 comprises performing each of the intermediate forming operations within an intermediate predetermined time period after quenching workpiece 102 in an immediately preceding heat-treatment operation. The preceding subject matter of the instant paragraph is in accordance with example 35 of the present disclosure, and example 35 includes the subject matter of example 33, above.

Performing the intermediate forming operation within the intermediate predetermined time period enables workpiece 102 to be worked before hardening due to natural aging prevents further forming or damages the ISF machine.

Referring generally to e.g., FIGS. 1-5 and specifically to FIG. 6, the intermediate predetermined time period is no more than one hour. The preceding subject matter of the instant paragraph is in accordance with example 36 of the present disclosure, and example 36 includes the subject matter of example 35, above.

Limiting the initial predetermined time period to an hour accommodates working of those alloys which can be worked for up to an hour before hardening due to natural aging interferes with ISF processing.

Referring generally to e.g., FIGS. 1-5 and specifically to FIG. 6, the intermediate predetermined time period is no more than one half hour. The preceding subject matter of the instant paragraph is in accordance with example 37 of the present disclosure, and example 37 includes the subject matter of example 35, above.

Limiting the initial predetermined time period to one half hour accommodates working of those alloys which can be worked for up to one half hour before hardening due to natural aging interferes with ISF processing.

Figure 7A:
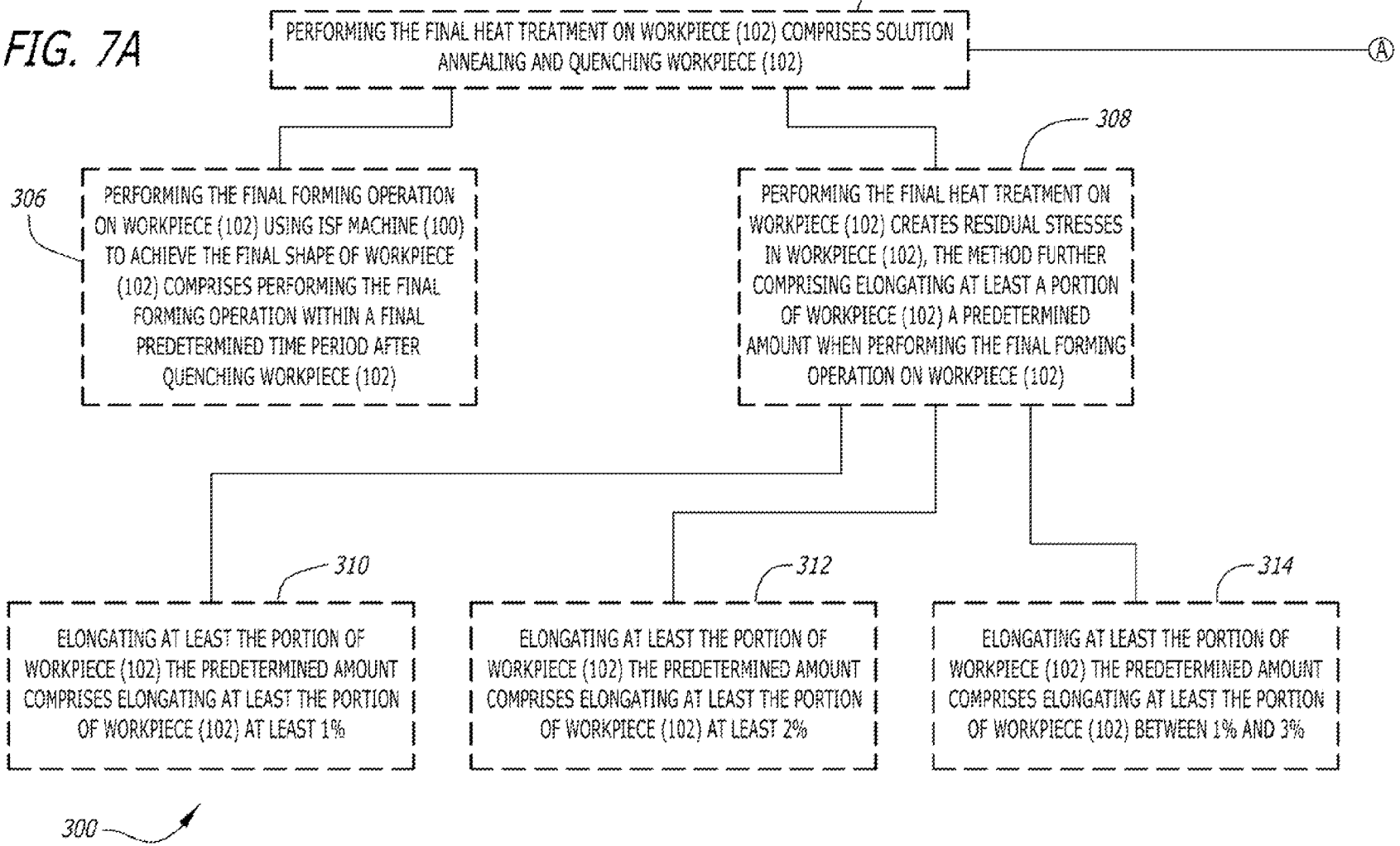
Figure 7B:
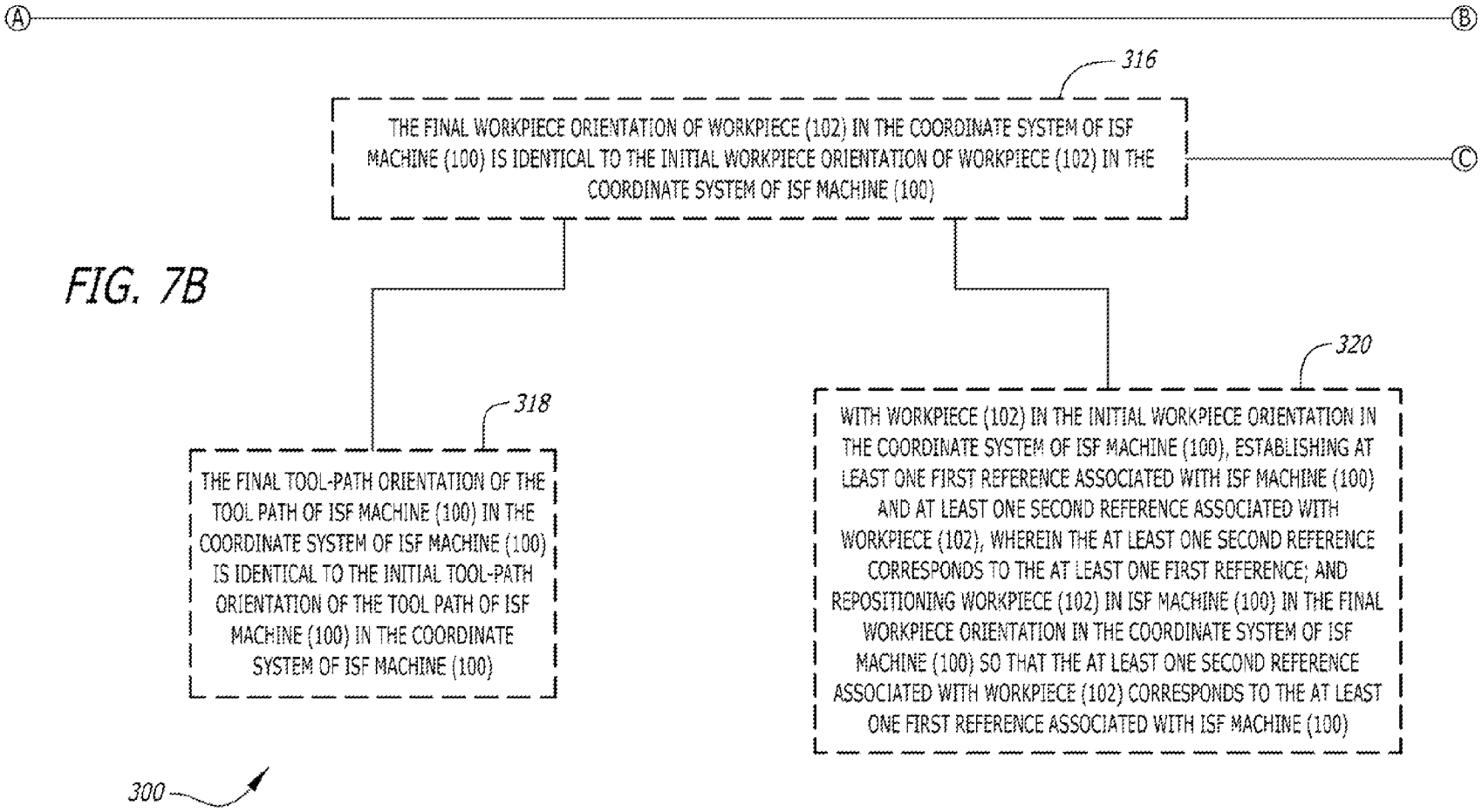
Figure 7C:
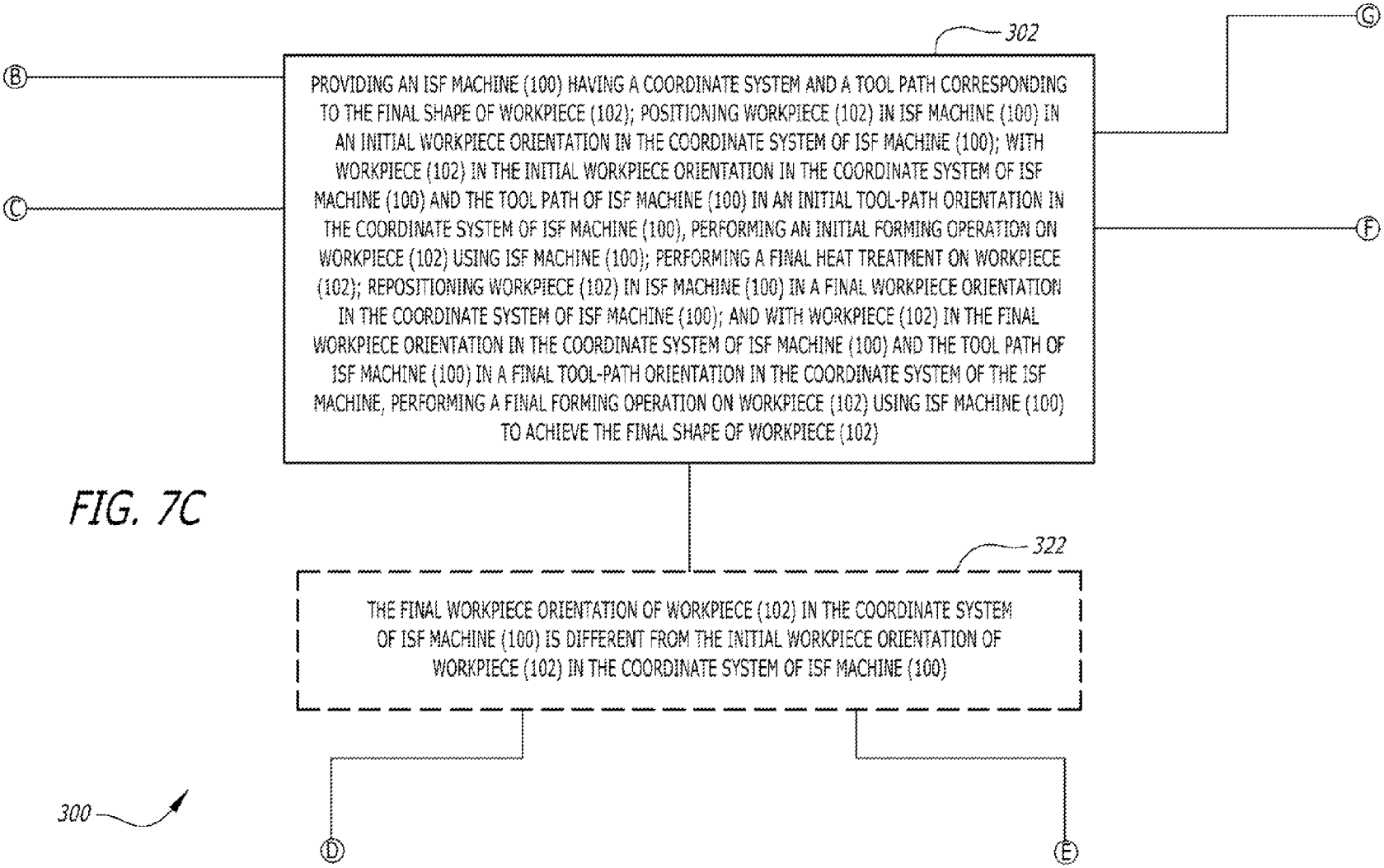

Referring generally to e.g., FIGS. 1-5 and specifically to FIG. 7C (block 302), method 300 of forming workpiece 102 made of a naturally aging alloy to a final shape, workpiece 102 having an initial heat treatment is disclosed. Method 300 comprises providing ISF machine 100 having a coordinate system and a tool path corresponding to the final shape of workpiece 102. Method 300 further comprises positioning workpiece 102 in ISF machine 100 in an initial workpiece orientation in the coordinate system of ISF machine 100. Method 300 further comprises, with workpiece 102 in the initial workpiece orientation in the coordinate system of ISF machine 100 and the tool path of ISF machine 100 in an initial tool-path orientation in the coordinate system of ISF machine 100, performing an initial forming operation on workpiece 102 using ISF machine 100. Method 300 also comprises performing a final heat treatment on workpiece 102. Method 300 further comprises repositioning workpiece 102 in ISF machine 100 in a final workpiece orientation in the coordinate system of ISF machine 100. Method 300 further comprises, with workpiece 102 in the final workpiece orientation in the coordinate system of ISF machine 100 and the tool path of ISF machine 100 in a final tool-path orientation in the coordinate system of ISF machine 100, performing a final forming operation on workpiece 102 using ISF machine 100 to achieve the final shape of workpiece 102. The preceding subject matter of the instant paragraph is in accordance with example 38 of the present disclosure.

The method of example 38 extends the amount of deformation which can be imparted to workpiece 102 by ISF methods, compared to ISF methods limited to one heat treatment.

Referring generally to e.g., FIGS. 1-5 and specifically to FIG. 7A (block 304), performing the final heat treatment on workpiece 102 comprises solution annealing and quenching workpiece 102. The preceding subject matter of the instant paragraph is in accordance with example 39 of the present disclosure, and example 39 includes the subject matter of example 38, above.

When the final heat treatment comprises solution annealing and quenching, workpiece 102 will eventually increase strength due to hardening while naturally aging.

Solution annealing softens workpiece 102 more than mill annealing, although subsequent hardening of workpiece 102 through natural aging will occur. Solution annealing may accommodate deformations by ISF processing that would not be possible with mill annealing. Solution annealing requires bringing the constituent alloy to temperatures close to its melting point. Illustratively, with aluminum alloys, temperatures of 800 or 900 degrees Fahrenheit will satisfy requirements of solution annealing. By contrast, mill annealing may require temperatures of 500 or 600 degrees Fahrenheit. The temperature ranges shown herein are exemplary, and may be extended from the listed values. The disclosed methods may apply also to alloys of magnesium, copper, nickel, titanium, and some stainless steels, in which case temperatures for mill and solution annealing will be different from those applicable to aluminum alloys.

Referring generally to e.g., FIGS. 1-5 and specifically to FIG. 7 (block 306), wherein performing the final forming operation on workpiece 102 using ISF machine 100 to achieve the final shape of workpiece 102 comprises performing the final forming operation within a final predetermined time period after quenching workpiece 102. The preceding subject matter of the instant paragraph is in accordance with example 40 of the present disclosure, and example 40 includes the subject matter of example 39, above.

Performing the final forming operation within the final predetermined time period enables workpiece 102 to be worked before hardening due to natural aging prevents further forming, or damages the ISF machine.

Referring generally to e.g., FIGS. 1-5 and specifically to FIG. 7, the final predetermined time period is no more than one hour. The preceding subject matter of the instant paragraph is in accordance with example 41 of the present disclosure, and example 41 includes the subject matter of example 40, above.

Limiting the initial predetermined time period to an hour accommodates working of those alloys which can be worked for up to an hour before hardening due to natural aging interferes with ISF processing. Aluminum alloy 2024 is an example of an alloy which can be worked for up to, but preferably not more than, an hour.

Referring generally to e.g., FIGS. 1-5 and specifically to FIG. 7, the final predetermined time period is no more than one half hour. The preceding subject matter of the instant paragraph is in accordance with example 42 of the present disclosure, and example 42 includes the subject matter of example 40, above.

Limiting the initial predetermined time period to a half hour accommodates working of those alloys which can be worked for up to a half hour before hardening due to natural aging interferes with ISF processing. Aluminum alloy 2024 is an example of an alloy which can be worked for up to, but preferably not more than, half an hour.

Referring generally to e.g., FIGS. 1-5 and specifically to FIG. 7A (block 308), performing the final heat treatment on workpiece 102 creates residual stresses in workpiece 102. Method 300 further comprises elongating at least a portion of workpiece 102 a predetermined amount when performing the final forming operation on workpiece 102. The preceding subject matter of the instant paragraph is in accordance with example 43 of the present disclosure, and example 43 includes the subject matter of any of examples 39-42, above.

Elongating workpiece 102 the predetermined amount relieves the residual stresses and avoids potential resultant deformation of workpiece 102. Elongating workpiece 102 is not a discrete step unto itself; rather, ISF operations are arranged such that they result in, at a minimum, the predetermined amount of elongation.

Referring generally to e.g., FIGS. 1-5 and specifically to FIG. 7A (block 310), elongating at least the portion of workpiece 102 the predetermined amount comprises elongating at least the portion of workpiece 102 at least 1%. The preceding subject matter of the instant paragraph is in accordance with example 44 of the present disclosure, and example 44 includes the subject matter of example 43, above.

Elongating workpiece 102 at least 1% relieves the residual stresses in some alloys.

Referring generally to e.g., FIGS. 1-5 and specifically to FIG. 7 (block 312), elongating at least the portion of workpiece 102 the predetermined amount comprises elongating at least the portion of the workpiece 102 at least 2%. The preceding subject matter of the instant paragraph is in accordance with example 45 of the present disclosure, and example 45 includes the subject matter of example 43, above.

Elongating workpiece 102 at least 2% relieves the residual stresses in some alloys which would not be relieved by, for example, 1% elongation.

Referring generally to e.g., FIGS. 1-5 and specifically to FIG. 7A (block 314), elongating at least the portion of workpiece 102 the predetermined amount comprises elongating at least the portion of workpiece 102 between 1% and 3%. The preceding subject matter of the instant paragraph is in accordance with example 46 of the present disclosure, and example 46 includes the subject matter of example 43, above.

Elongating workpiece 102 between 1% and 3% relieves residual stresses in many if not most aluminum alloys.

Referring generally to e.g., FIGS. 1-5 and specifically to FIG. 7B (block 316), the final workpiece orientation of workpiece 102 in the coordinate system of ISF machine 100 is identical to the initial workpiece orientation of workpiece 102 in the coordinate system of ISF machine 100. The preceding subject matter of the instant paragraph is in accordance with example 47 of the present disclosure, and example 47 includes the subject matter of any of examples 38-46, above.

Identical initial and final workpiece orientations enable ISF operations to proceed seamlessly after being interrupted for a subsequent heat treatment after the initial forming operation, without introducing a distortion of the tool path at the point of resuming ISF operations.

Referring generally to e.g., FIGS. 1-5 and specifically to FIG. 7B (block 318), the final tool-path orientation of the tool path of ISF machine 100 in the coordinate system of ISF machine 100 is identical to the initial tool-path orientation of the tool path of ISF machine 100 in the coordinate system of ISF machine 100. The preceding subject matter of the instant paragraph is in accordance with example 48 of the present disclosure, and example 48 includes the subject matter of example 47, above.

Identical final tool-path orientation relative to the initial tool-path orientation assures seamless continuity of a subsequent ISF operation, thereby achieving the intended final shape of workpiece 102. With identical initial and final tool-path orientations, ISF machine 100 may resume ISF operations without being obliged to compensate for misalignment of the uncompleted portion of the tool path with the completed portion.

Referring generally to e.g., FIGS. 1-5 and specifically to FIG. 7B (block 320), method 300 further comprises, with workpiece 102 in the initial workpiece orientation in the coordinate system of ISF machine 100, establishing at least one first reference associated with ISF machine 100 and at least one second reference associated with workpiece 102. The at least one second reference corresponds to the at least one first reference. Method 300 also comprises repositioning workpiece 102 in ISF machine 100 in the final workpiece orientation in the coordinate system of ISF machine 100 so that the at least one second reference associated with workpiece 102 corresponds to the at least one first reference associated with ISF machine 100. The preceding subject matter of the instant paragraph is in accordance with example 49 of the present disclosure, and example 49 includes the subject matter of any of examples 47 and 48, above.

Corresponding references on ISF machine 100 and workpiece 102 enable the latter to be replaced in ISF machine 100 after a heat treatment in a position such that subsequent ISF operations result in seamlessly resuming the intended tool path of ISF machine 100. Placement of workpiece 102 in the ISF machine may be manually performed.

References may be obtained in a number of ways. For example, a sensor (not shown) may identify predetermined points on workpiece 102, and record these relative to the coordinate system of ISF machine 100. Alternatively, optical scanning may be used to map predetermined or machine identified points on workpiece 102 to reference points of ISF machine 100. References may also be manually determined by the operator of ISF machine 100. Location of an edge of or a point on workpiece 102 may be measured from an arbitrary point on a workpiece support surface (not shown) of ISF machine 100, with measured values being replicated when workpiece 102 is replaced in ISF machine 100 following a heat treatment, for example.

Referring generally to e.g., FIGS. 1-5 and specifically to FIG. 7C (block 322), the final workpiece orientation of workpiece 102 in the coordinate system of ISF machine 100 is different from the initial workpiece orientation of workpiece 102 in the coordinate system of ISF machine 100. The preceding subject matter of the instant paragraph is in accordance with example 50 of the present disclosure, and example 50 includes the subject matter of any of examples 38-46, above.

If not required to be oriented identically within the coordinate system of ISF machine 100, replacement of workpiece 102 within ISF machine 100 can be performed more expeditiously, hence leaving more time for ISF operations before hardening due to natural aging limits the ISF process. Different initial and final orientations of workpiece 102 may arise, for example, when workpiece 102 is manually replaced in ISF machine 100 following heat treatment(s).

Figure 7D:
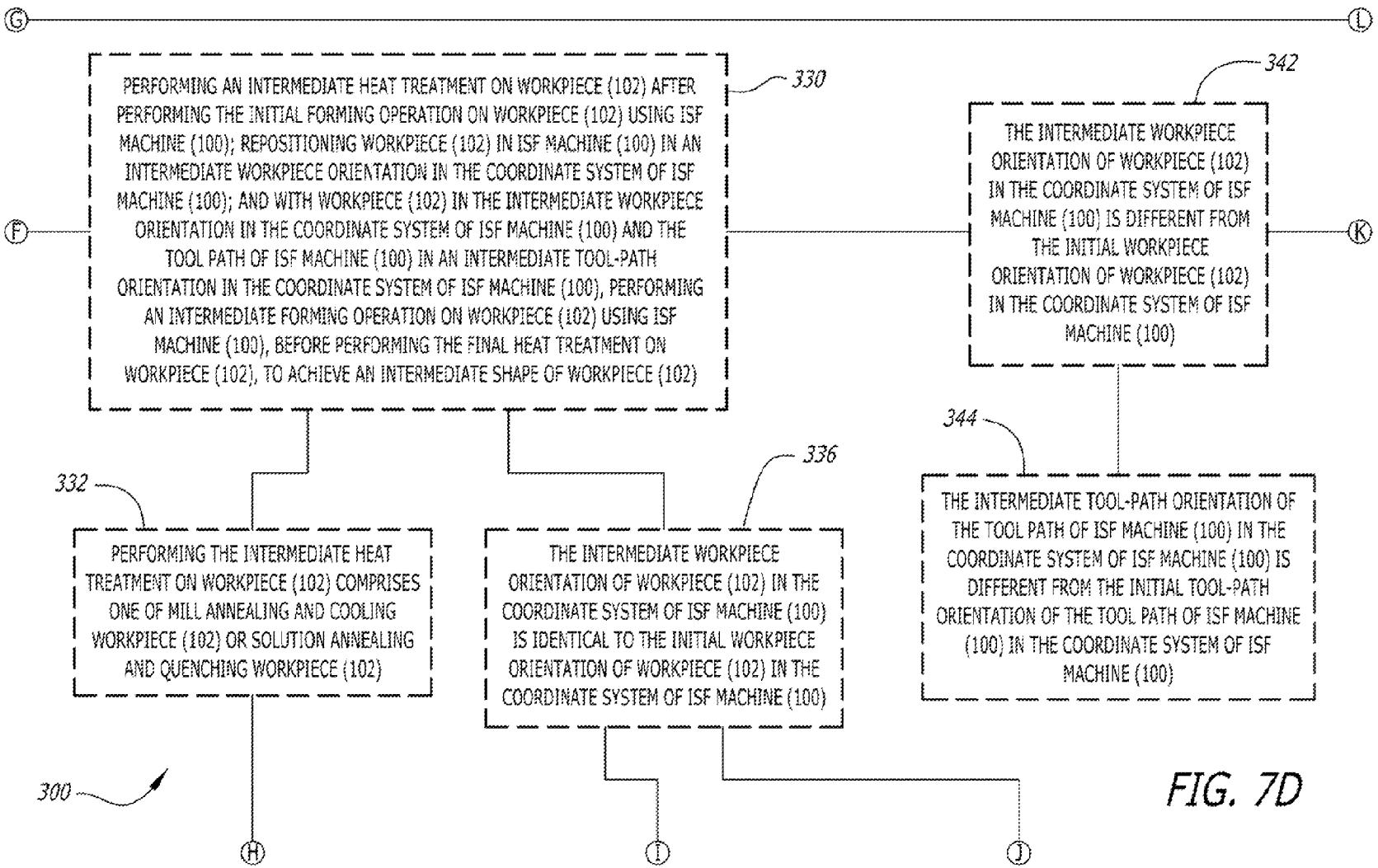
Figure 7E:
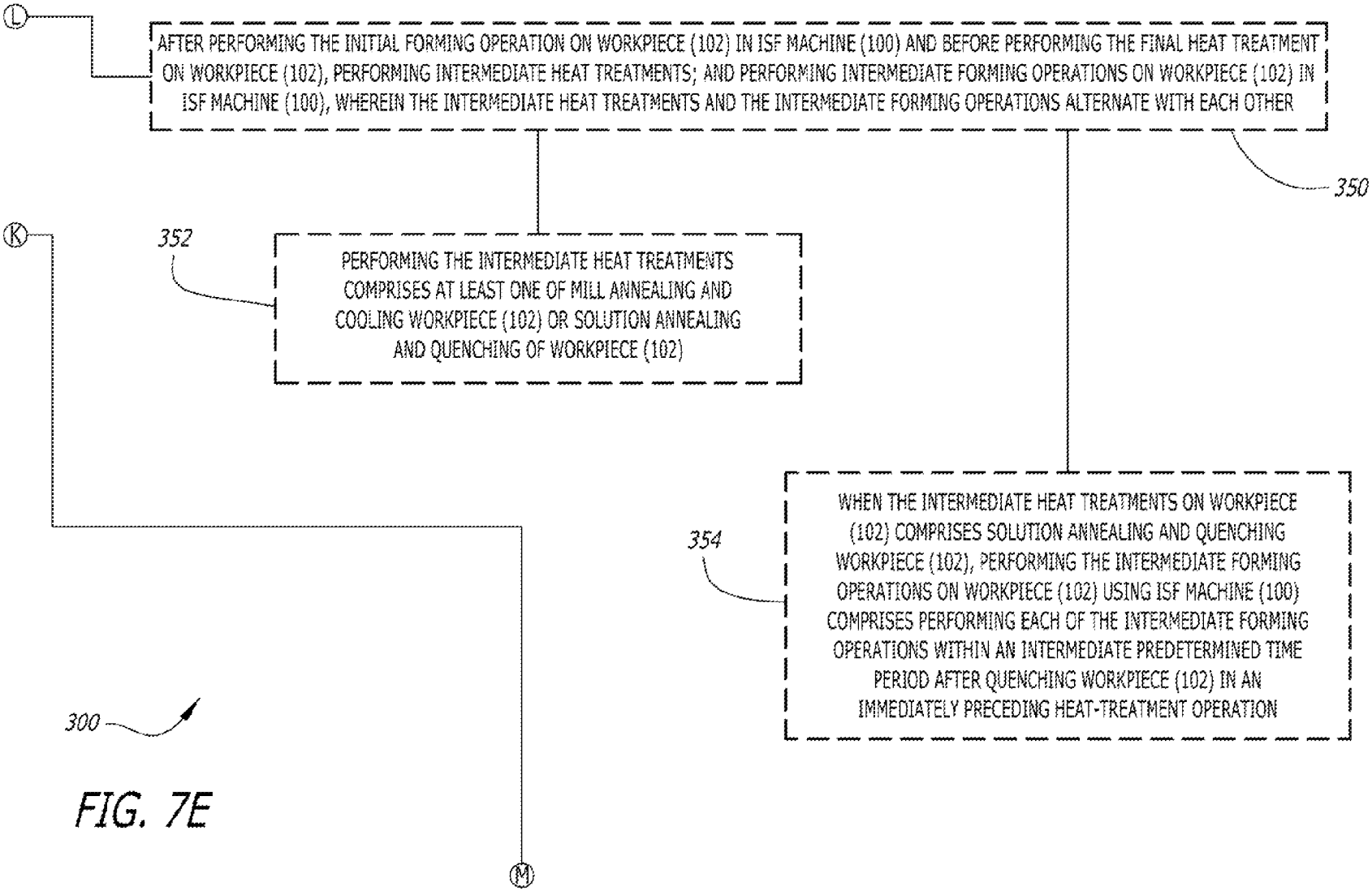
Figure 7F:
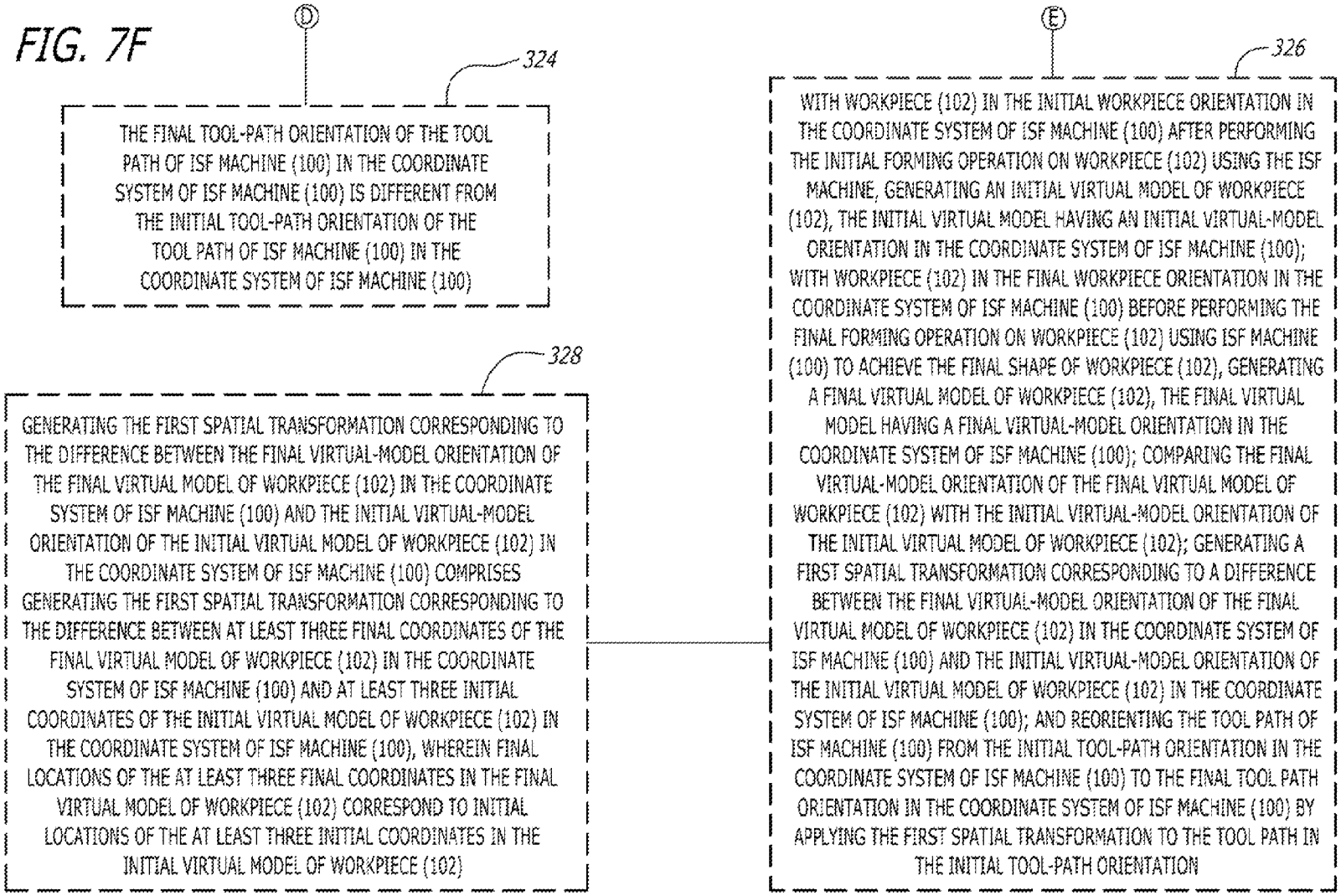

Referring generally to e.g., FIGS. 1-5 and specifically to FIG. 7F (block 324), the final tool-path orientation of the tool path of ISF machine 100 in the coordinate system of ISF machine 100 is different from the initial tool-path orientation of the tool path of ISF machine 100 in the coordinate system of ISF machine 100. The preceding subject matter of the instant paragraph is in accordance with example 51 of the present disclosure, and example 51 includes the subject matter of example 50, above.

A different final tool-path orientation may accommodate replacement of workpiece 102 in ISF machine 100 in a new orientation such that subsequent ISF operations result in seamlessly resuming the intended tool path of ISF machine 100 relative to workpiece 102.

Resumption of the tool path may include machine compensation for the different final tool-path orientation, so that the hypothetical tool path is not affected by the different final tool-path orientation.

Referring generally to e.g., FIGS. 1-5 and specifically to FIG. 7F (block 326), method 300 further comprises, with workpiece 102 in the initial workpiece orientation in the coordinate system of ISF machine 100 after performing the initial forming operation on workpiece 102 using ISF machine 100, generating an initial virtual model of workpiece 102, the initial virtual model having an initial virtual-model orientation in the coordinate system of ISF machine 100. Method 300 also comprises, with workpiece 102 in the final workpiece orientation in the coordinate system of ISF machine 100 before performing the final forming operation on workpiece 102 using ISF machine 100 to achieve the final shape of workpiece 102, generating a final virtual model of workpiece 102, the final virtual model having a final virtual-model orientation in the coordinate system of ISF machine 100. Method 300 further comprises comparing the final virtual-model orientation of the final virtual model of workpiece 102 with the initial virtual-model orientation of the initial virtual model of workpiece 102. Method 300 also comprises generating a first spatial transformation corresponding to a difference between the final virtual-model orientation of the final virtual model of workpiece 102 in the coordinate system of ISF machine 100 and the initial virtual-model orientation of the initial virtual model of workpiece 102 in the coordinate system of ISF machine 100. Method 300 further comprises reorienting the tool path of ISF machine 100 from the initial tool-path orientation in the coordinate system of ISF machine 100 to the final tool path orientation in the coordinate system of ISF machine 100 by applying the first spatial transformation to the tool path in the initial tool-path orientation. The preceding subject matter of the instant paragraph is in accordance with example 52 of the present disclosure, and example 52 includes the subject matter of any of examples 50 and 51, above.

Reorienting the tool path of ISF machine 100 from the initial tool-path orientation results in seamlessly resuming the intended tool path of ISF machine 100 relative to workpiece 102 even when workpiece 102 has been repositioned in a new orientation in ISF machine 100 following a heat treatment.

The initial and final virtual models allow selected points of each to be identified and compared for subsequent adjustment of the trajectory of the tool path upon resumption of ISF operations.

Referring generally to e.g., FIGS. 1-5 and specifically to FIG. 7F (block 328), generating the first spatial transformation corresponding to the difference between the final virtual-model orientation of the final virtual model of workpiece 102 in the coordinate system of ISF machine 100 and the initial virtual-model orientation of the initial virtual model of workpiece 102 in the coordinate system of ISF machine 100 comprises generating the first spatial transformation corresponding to the difference between at least three final coordinates of the final virtual model of workpiece 102 in the coordinate system of ISF machine 100 and at least three initial coordinates of the initial virtual model of workpiece 102 in the coordinate system of ISF machine 100. Final locations of the at least three final coordinates in the final virtual model of workpiece 102 correspond to initial locations of the at least three initial coordinates in the initial virtual model of workpiece 102. The preceding subject matter of the instant paragraph is in accordance with example 53 of the present disclosure, and example 53 includes the subject matter of example 52, above.

Appropriate adjustment of an uncompleted portion of the tool path relative to a completed portion is thereby achievable based on sensing position of workpiece 102 in ISF machine 100.

The at least three coordinates of the initial and final virtual models of workpiece 102 correspond to the selected points to be identified and compared.

Referring generally to e.g., FIGS. 1-5 and specifically to FIG. 7B (block 330), method 300 further comprises performing an intermediate heat treatment on workpiece 102 after performing the initial forming operation on workpiece 102 using ISF machine 100. Method 300 also comprises repositioning workpiece 102 in ISF machine 100 in an intermediate workpiece orientation in the coordinate system of ISF machine 100. Method 300 further comprises, with workpiece 102 in the intermediate workpiece orientation in the coordinate system of ISF machine 100 and the tool path of ISF machine 100 in an intermediate tool-path orientation in the coordinate system of ISF machine 100, performing an intermediate forming operation on workpiece 102 using ISF machine 100, before performing the final heat treatment on workpiece 102, to achieve an intermediate shape of workpiece 102. The preceding subject matter of the instant paragraph is in accordance with example 54 of the present disclosure, and example 54 includes the subject matter any of examples 38-53, above.

An intermediate heat treatment enables extended ISF operations to be conducted on workpiece 102, thereby enabling workpiece 102, even if large or complicated, to be successfully formed by the ISF process.

Referring generally to e.g., FIGS. 1-5 and specifically to FIG. 7D (block 332), performing the intermediate heat treatment on workpiece 102 comprises one of mill annealing and cooling workpiece 102 or solution annealing and quenching workpiece 102. The preceding subject matter of the instant paragraph is in accordance with example 55 of the present disclosure, and example 55 includes the subject matter of example 54, above.

Mill annealing and solution annealing are heat treatments which soften workpiece 102, so that the latter will be successfully formed in subsequent ISF operations.

Referring generally to e.g., FIGS. 1-3 and 5, and specifically to FIG. 7D (block 334), when the intermediate heat treatment on workpiece 102 comprises solution annealing and quenching workpiece 102, performing the intermediate forming operation on workpiece 102 using ISF machine 100 comprises performing the intermediate forming operation within an intermediate predetermined time period after quenching workpiece 102. The preceding subject matter of the instant paragraph is in accordance with example 56 of the present disclosure, and example 56 includes the subject matter of example 54, above.

Performing the intermediate forming operation within the intermediate predetermined time period after quenching enables those alloys which harden due to natural aging to be worked by ISF processing before hardening interferes with ISF processing.

Referring generally to e.g., FIGS. 1-3 and 5, and specifically to FIG. 7, the intermediate predetermined time period is no more than one hour. The preceding subject matter of the instant paragraph is in accordance with example 57 of the present disclosure, and example 57 includes the subject matter of example 56, above.

Limiting the intermediate predetermined time period to an hour accommodates working of those alloys which can be worked for up to an hour before hardening due to natural aging interferes with ISF processing.

Referring generally to e.g., FIGS. 1-3 and 5, and specifically to FIG. 7, the intermediate predetermined time period is no more than one half hour. The preceding subject matter of the instant paragraph is in accordance with example 58 of the present disclosure, and example 58 includes the subject matter of example 56, above.

Limiting the intermediate predetermined time period to an hour accommodates working of those alloys which can be worked for up to a half hour before hardening due to natural aging interferes with ISF processing.

Referring generally to e.g., FIGS. 1-5 and specifically to FIG. 7D (block 336), the intermediate workpiece orientation of workpiece 102 in the coordinate system of ISF machine 100 is identical to the initial workpiece orientation of workpiece 102 in the coordinate system of ISF machine 100. The preceding subject matter of the instant paragraph is in accordance with example 59 of the present disclosure, and example 59 includes the subject matter of any of examples 54-58, above.

Identical initial and intermediate workpiece orientations enable ISF operations to proceed seamlessly, without distortion of the tool path, after being interrupted for a subsequent heat treatment after the initial forming operation.

Referring generally to e.g., FIGS. 1-5 and specifically to FIG. 7 (block 338), the intermediate tool-path orientation of the tool path of ISF machine 100 in the coordinate system of ISF machine 100 is identical to the initial tool-path orientation of the tool path of ISF machine 100 in the coordinate system of ISF machine 100. The preceding subject matter of the instant paragraph is in accordance with example 60 of the present disclosure, and example 60 includes the subject matter of example 59, above.

Identical intermediate tool-path orientation relative to the initial tool-path orientation assures seamless continuity of a subsequent ISF operation, thereby achieving the intended final shape of workpiece 102.

Figure 7G:
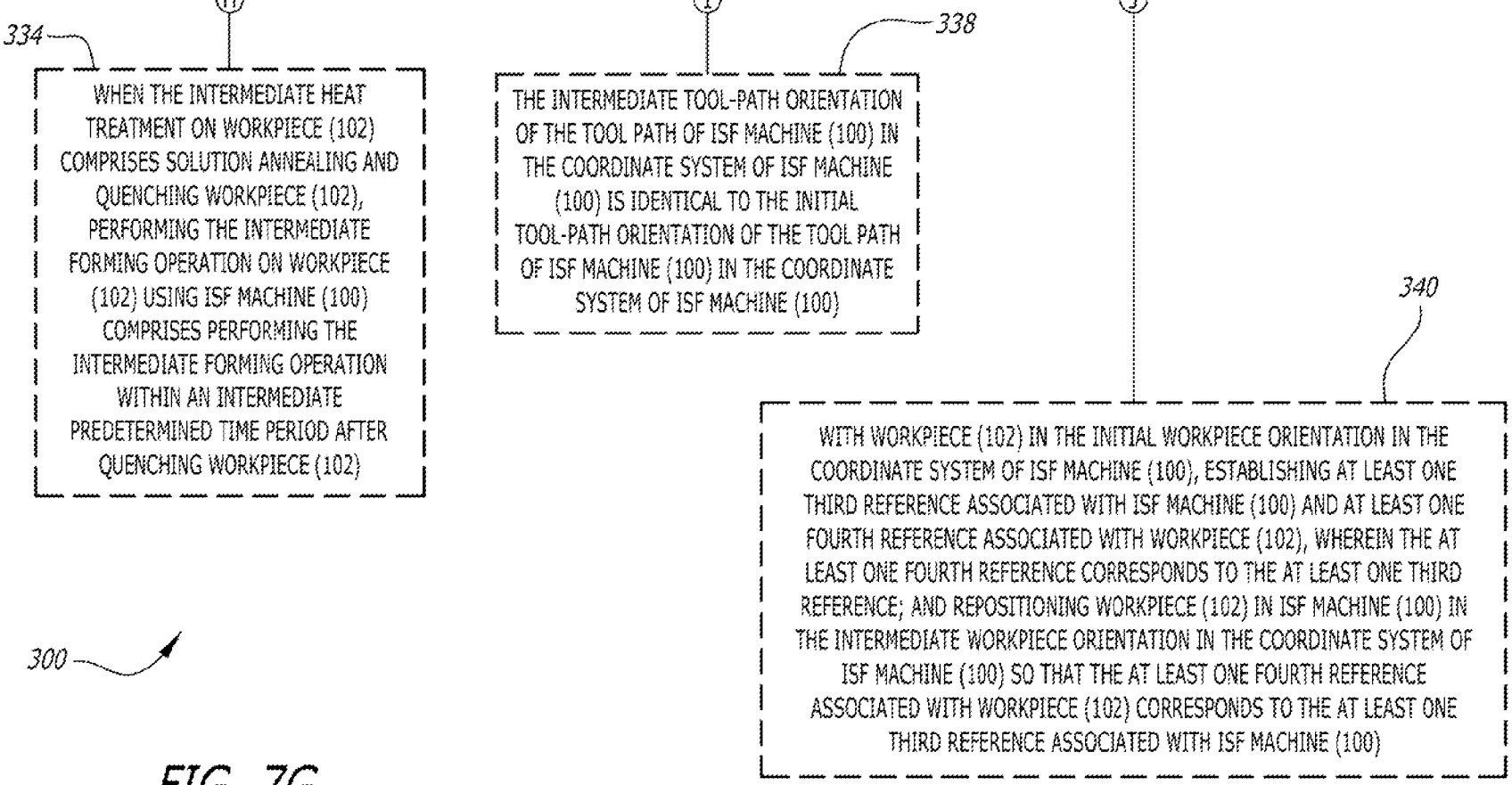

Referring generally to e.g., FIGS. 1-5 and specifically to FIG. 7G (block 340), method 300 further comprises, with workpiece 102 in the initial workpiece orientation in the coordinate system of ISF machine 100, establishing at least one third reference associated with ISF machine 100 and at least one fourth reference associated with workpiece 102. The at least one fourth reference corresponds to the at least one third reference. Method 300 also comprises repositioning workpiece 102 in ISF machine 100 in the intermediate workpiece orientation in the coordinate system of ISF machine 100 so that the at least one fourth reference associated with workpiece 102 corresponds to the at least one third reference associated with ISF machine 100. The preceding subject matter of the instant paragraph is in accordance with example 61 of the present disclosure, and example 61 includes the subject matter of any of examples 59 and 60, above.

This minimizes effort of replacing workpiece 102 in ISF machine 100 following a heat treatment, thereby conserving time which extend time available for ISF operations before workpiece 102 hardens due to natural aging.

The third and fourth references may correspond in nature to the first and second references described above.

Referring generally to e.g., FIGS. 1-5 and specifically to FIG. 7D (block 342), the intermediate workpiece orientation of workpiece 102 in the coordinate system of ISF machine 100 is different from the initial workpiece orientation of workpiece 102 in the coordinate system of ISF machine 100. The preceding subject matter of the instant paragraph is in accordance with example 62 of the present disclosure, and example 62 includes the subject matter of any of examples 54-58, above.

This minimizes demands on accuracy and hence time when replacing workpiece 102 in ISF machine 100. Different initial and intermediate orientations of workpiece 102 may arise, for example, when workpiece 102 is manually replaced in ISF machine 100 following heat treatment(s).

Referring generally to e.g., FIGS. 1-5 and specifically to FIG. 7 (block 344), the intermediate tool-path orientation of the tool path of ISF machine 100 in the coordinate system of ISF machine 100 is different from the initial tool-path orientation of the tool path of ISF machine 100 in the coordinate system of ISF machine 100. The preceding subject matter of the instant paragraph is in accordance with example 63 of the present disclosure, and example 63 includes the subject matter of example 62, above.

If not required to be oriented identically within the coordinate system of ISF machine 100, replacement of workpiece 102 within ISF machine 100 is achieved more expeditiously, hence leaving more time for ISF operations before hardening due to natural aging limits the ISF process. Different initial and final tool-path orientations may arise, for example, when workpiece 102 is manually replaced in ISF machine 100 following heat treatment(s).

Referring generally to e.g., FIGS. 1-5 and specifically to FIG. 7 (block 346), method 300 further comprises, with workpiece 102 in the initial workpiece orientation in the coordinate system of ISF machine 100 after performing the initial forming operation on workpiece 102 using ISF machine 100, generating an initial virtual model of workpiece 102. The initial virtual model has an initial virtual-model orientation in the coordinate system of ISF machine 100. Method 300 also comprises, with workpiece 102 in the intermediate workpiece orientation in the coordinate system of ISF machine 100 before performing the intermediate forming operation on workpiece 102 using ISF machine 100 to achieve the intermediate shape of workpiece 102, generating an intermediate virtual model of workpiece 102. The intermediate virtual model has an intermediate virtual-model orientation in the coordinate system of ISF machine 100, with workpiece 102 in the intermediate workpiece orientation in the coordinate system of ISF machine 100. Method 300 further comprises comparing the intermediate virtual-model orientation of the intermediate virtual model of workpiece 102 with the initial virtual-model orientation of the initial virtual model of workpiece 102. Method 300 also comprises generating a second spatial transformation corresponding to a difference between the intermediate virtual-model orientation of the intermediate virtual model of workpiece 102 in the coordinate system of ISF machine 100 and the initial virtual-model orientation of the initial virtual model of workpiece 102 in the coordinate system of ISF machine 100. Method 300 further comprises reorienting the tool path of ISF machine 100 from the initial tool-path orientation in the coordinate system of ISF machine 100 to the intermediate tool-path orientation in the coordinate system of ISF machine 100 by applying the second spatial transformation to the initial tool-path orientation. The preceding subject matter of the instant paragraph is in accordance with example 64 of the present disclosure, and example 64 includes the subject matter of any of examples 62 and 63, above.

Reorienting the tool path of ISF machine 100 from the initial tool-path orientation, based on the initial and intermediate virtual models, results in seamlessly resuming the intended tool path of ISF machine 100 relative to workpiece 102 even when workpiece 102 has been repositioned in a new orientation in ISF machine 100 following a heat treatment.

Figure 7H:
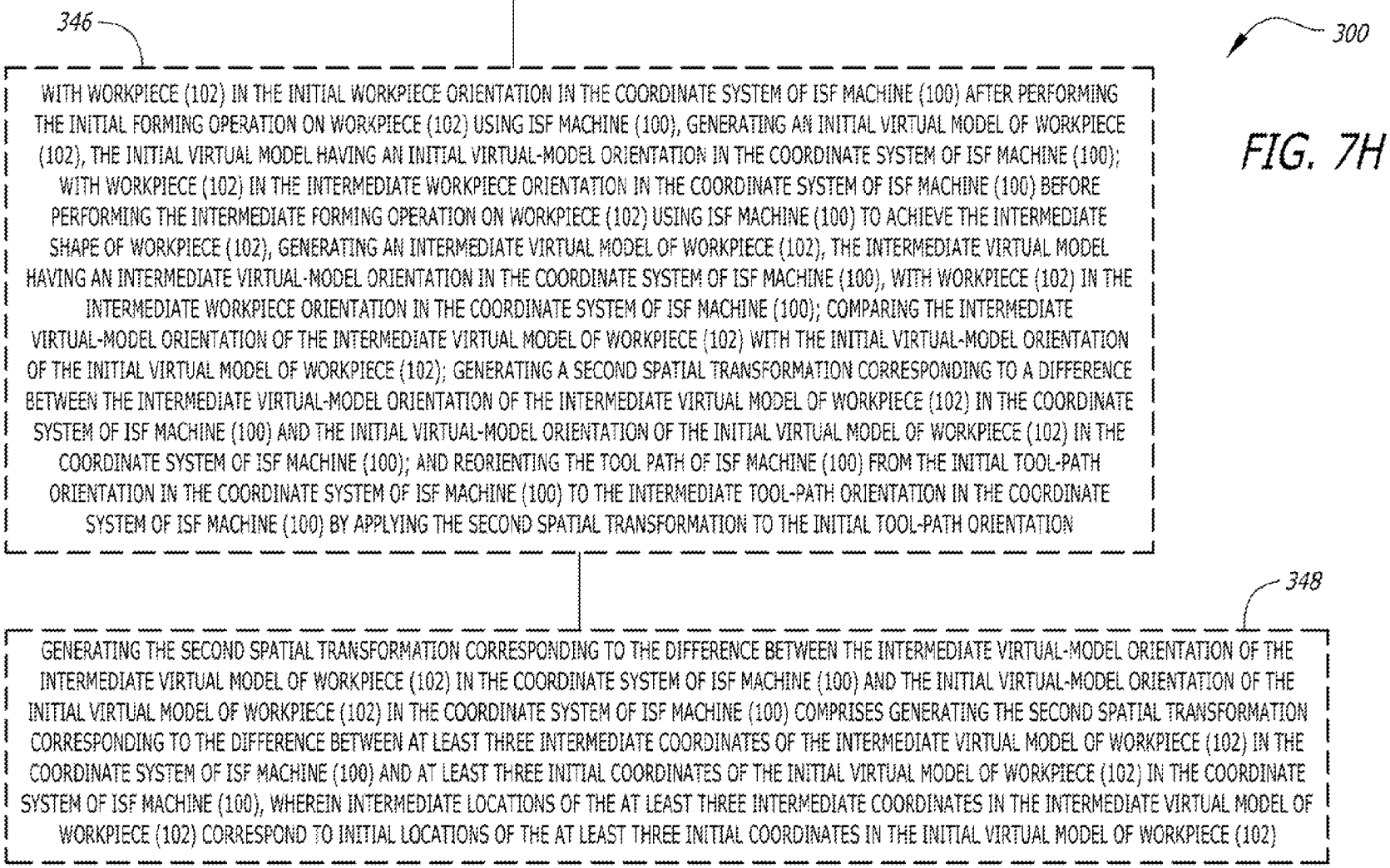

Referring generally to e.g., FIGS. 1-5 and specifically to FIG. 7H (block 348), generating the second spatial transformation corresponding to the difference between the intermediate virtual-model orientation of the intermediate virtual model of workpiece 102 in the coordinate system of ISF machine 100 and the initial virtual-model orientation of the initial virtual model of workpiece 102 in the coordinate system of ISF machine 100 comprises generating the second spatial transformation corresponding to the difference between at least three intermediate coordinates of the intermediate virtual model of workpiece 102 in the coordinate system of ISF machine 100 and at least three initial coordinates of the initial virtual model of workpiece 102 in the coordinate system of ISF machine 100. Intermediate locations of the at least three intermediate coordinates in the intermediate virtual model of workpiece 102 correspond to initial locations of the at least three initial coordinates in the initial virtual model of workpiece 102. The preceding subject matter of the instant paragraph is in accordance with example 65 of the present disclosure, and example 65 includes the subject matter of example 64, above.

Appropriate adjustment of an uncompleted portion of the tool path relative to a completed portion is achievable by sensing position of workpiece 102, based on the at least three initial and final coordinates, in ISF machine 100.

Referring generally to e.g., FIGS. 1-5 and specifically to FIG. 7E (block 350), method 200 further comprises, after performing the initial forming operation on workpiece 102 in ISF machine 100 and before performing the final heat treatment on workpiece 102, performing intermediate heat treatments. Method 300 also comprises performing intermediate forming operations on workpiece 102 in ISF machine 100. The intermediate heat treatments and the intermediate forming operations alternate with each other. The preceding subject matter of the instant paragraph is in accordance with example 66 of the present disclosure, and example 66 includes the subject matter of any of examples 38-53, above.

Intermediate heat treatments enable extended ISF operations to be conducted on workpiece 102, thereby enabling workpiece 102, even if large or complicated, to be successfully formed by the ISF process.

An intermediate heat treatment occurs after the initial ISF forming operation and before the final heat treatment. In FIGS. 2-5, there are two intermediate heat treatments, each including a cooling step of either quenching (FIGS. 2, 3, and 5), in the case of solution annealing, or, with mill annealing, air cooling (FIGS. 4 and 5), followed by repositioning of workpiece 102 in ISF machine 100. FIG. 2 depicts four total heat treatments and ISF operations. FIGS. 3-5 depict five total heat treatments and ISF operations. With aluminum alloys, three to six heat treatments and ISF operations are feasible.

In FIG. 2, all of the heat treatments are solution annealing. This maximizes softness of workpiece 102, thereby permitting the greatest amount of deformation when conducting ISF operations. FIG. 3 shows an initial mill annealing heat treatment, wherein all subsequent heat treatments are solution annealing. Time from fabrication of the sheet stock which subsequently becomes workpiece 102 to the first ISF operation is not limited when the heat treatment is mill annealing. Consequently, the initial mill annealing may be conducted either at the ISF facility or at the facility preparing the sheet stock.

FIG. 4 shows a process wherein all of the heat treatments except the final heat treatment are mill annealing. The process of FIG. 4 allows for maximally extended working times in ISF forming operations before hardening due to natural aging forces discontinuation of ISF operations.

FIG. 5 shows a mix of mill annealing and solution annealing. This option enables a mix of lengthy or extended working times in ISF forming operations with some ISF forming operations providing relatively great deformation of workpiece 102.

Referring generally to e.g., FIGS. 1-5 and specifically to FIG. 7E (block 352), performing the intermediate heat treatments comprises at least one of mill annealing and cooling workpiece 102 or solution annealing and quenching of workpiece 102. The preceding subject matter of the instant paragraph is in accordance with example 67 of the present disclosure, and example 67 includes the subject matter of example 66, above.

Mill annealing and solution annealing are heat treatments which soften workpiece 102, so that the latter will be successfully formed in subsequent ISF operations.

Referring generally to e.g., FIGS. 1-5 and specifically to FIG. 7E (block 354), when the intermediate heat treatments on workpiece 102 comprises solution annealing and quenching workpiece 102, performing the intermediate forming operations on workpiece 102 using ISF machine 100 comprises performing each of the intermediate forming operations within an intermediate predetermined time period after quenching workpiece 102 in an immediately preceding heat-treatment operation. The preceding subject matter of the instant paragraph is in accordance with example 68 of the present disclosure, and example 68 includes the subject matter of example 66, above.

Performing the intermediate forming operations within the intermediate predetermined time period enables workpiece 102 to be worked before hardening due to natural aging prevents further forming or damages the ISF machine.

Referring generally to e.g., FIGS. 1-5 and specifically to FIG. 7, the intermediate predetermined time period is no more than one hour. The preceding subject matter of the instant paragraph is in accordance with example 69 of the present disclosure, and example 69 includes the subject matter of example 68, above.

Limiting the intermediate predetermined time period to an hour accommodates working of those alloys which can be worked for up to an hour before hardening due to natural aging interferes with ISF processing.

Referring generally to e.g., FIGS. 1-5 and specifically to FIG. 7, the intermediate predetermined time period is no more than one half hour. The preceding subject matter of the instant paragraph is in accordance with example 70 of the present disclosure, and example 70 includes the subject matter of example 68, above.

Limiting the initial predetermined time period to a half hour accommodates working of those alloys which can be worked for up to a half hour before hardening due to natural aging interferes with ISF processing.

Figure 9:
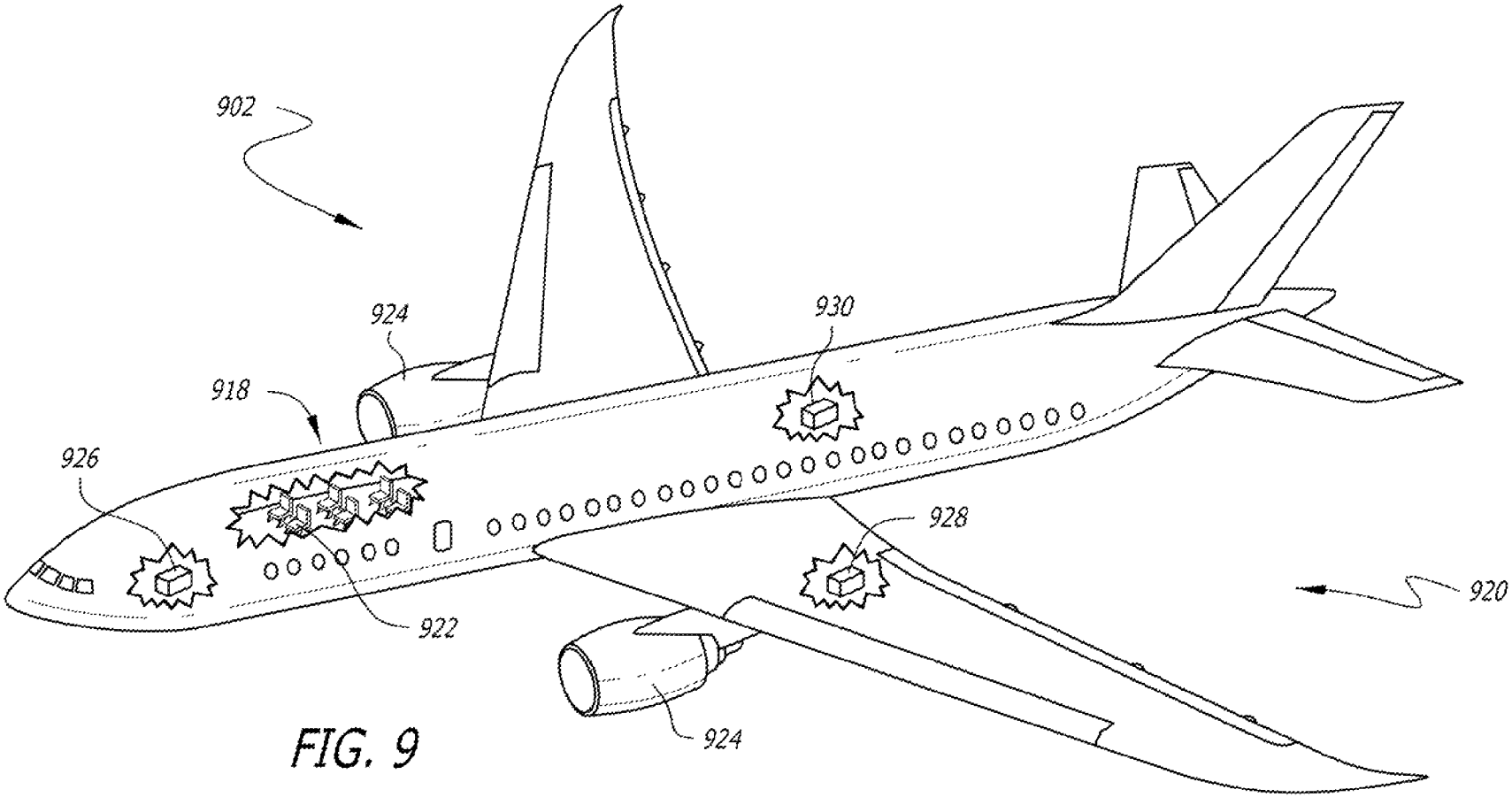

Examples of the present disclosure may be described in the context of aircraft manufacturing and service method 1100 as shown in FIG. 8 and aircraft 1102 as shown in FIG. 9. During pre-production, illustrative method 1100 may include specification and design (block 1104) of aircraft 1102 and material procurement (block 1106). During production, component and subassembly manufacturing (block 1108) and system integration (block 1110) of aircraft 1102 may take place. Thereafter, aircraft 1102 may go through certification and delivery (block 1112) to be placed in service (block 1114). While in service, aircraft 1102 may be scheduled for routine maintenance and service (block 1116). Routine maintenance and service may include modification, reconfiguration, refurbishment, etc. of one or more systems of aircraft 1102.

Each of the processes of illustrative method 1100 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 9, aircraft 1102 produced by illustrative method 1100 may include airframe 1118 with a plurality of high-level systems 1120 and interior 1122. Examples of high-level systems 1120 include one or more of propulsion system 1124, electrical system 1126, hydraulic system 1128, and environmental system 1130. Any number of other systems may be included. Although an aerospace example is shown, the principles disclosed herein may be applied to other industries, such as the automotive industry. Accordingly, in addition to aircraft 1102, the principles disclosed herein may apply to other vehicles, e.g., land vehicles, marine vehicles, space vehicles, etc.

Apparatus(es) and method(s) shown or described herein may be employed during any one or more of the stages of the manufacturing and service method 1100. For example, components or subassemblies corresponding to component and subassembly manufacturing 1108 may be fabricated or manufactured in a manner similar to components or subassemblies produced while aircraft 1102 is in service. Also, one or more examples of the apparatus(es), method(s), or combination thereof may be utilized during production stages 1108 and 1110, for example, by substantially expediting assembly of or reducing the cost of aircraft 1102. Similarly, one or more examples of the apparatus or method realizations, or a combination thereof, may be utilized, for example and without limitation, while aircraft 1102 is in service, e.g., maintenance and service stage (block 1116).

Different examples of the apparatus(es) and method(s) disclosed herein include a variety of components, features, and functionalities. It should be understood that the various examples of the apparatus(es) and method(s) disclosed herein may include any of the components, features, and functionalities of any of the other examples of the apparatus(es) and method(s) disclosed herein in any combination, and all of such possibilities are intended to be within the spirit and scope of the present disclosure.

Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples presented and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims.

What is claimed is:

1. A method of forming a workpiece made of a naturally aging alloy to a final shape, the method comprising:

providing an ISF machine having a coordinate system and a tool path corresponding to the final shape of the workpiece;

performing an initial heat treatment on the workpiece;

positioning the workpiece in the ISF machine in an initial workpiece orientation in the coordinate system of the ISF machine;

with the workpiece in the initial workpiece orientation in the coordinate system of the ISF machine and the tool path of the ISF machine in an initial tool-path orientation in the coordinate system of the ISF machine, performing an initial forming operation on the workpiece using the ISF machine;

performing a final heat treatment on the workpiece;

repositioning the workpiece in the ISF machine in a final workpiece orientation in the coordinate system of the ISF machine; and with the workpiece in the final workpiece orientation in the coordinate system of the ISF machine and the tool path of the ISF machine in a final tool-path orientation in the coordinate system of the ISF machine, performing a final forming operation on the workpiece using the ISF machine to achieve the final shape of the workpiece.

2. The method according to claim 1, wherein performing the initial heat treatment on the workpiece comprises one of:

mill annealing and cooling the workpiece or solution annealing and quenching the workpiece.

3. The method according to claim 1, wherein, when the initial heat treatment on the workpiece comprises solution annealing and quenching the workpiece, performing the initial forming operation on the workpiece using the ISF machine comprises performing the initial forming operation within an initial predetermined time period after quenching the workpiece.

4. The method according to claim 1, wherein performing the final heat treatment on the workpiece comprises solution annealing and quenching the workpiece.

5. The method according to claim 4, wherein performing the final heat treatment on the workpiece creates residual stresses in the workpiece, the method further comprising elongating at least a portion of the workpiece a predetermined amount when performing the final forming operation on the workpiece.

6. The method according to claim 1, wherein the final workpiece orientation of the workpiece in the coordinate system of the ISF machine is identical to the initial workpiece orientation of the workpiece in the coordinate system of the ISF machine.

7. The method according to claim 1, wherein the final workpiece orientation of the workpiece in the coordinate system of the ISF machine is different from the initial workpiece orientation of the workpiece in the coordinate system of the ISF machine.

8. The method according to claim 1, further comprising:

performing an intermediate heat treatment on the workpiece after performing the initial forming operation on the workpiece using the ISF machine;

repositioning the workpiece in the ISF machine in an intermediate workpiece orientation in the coordinate system of the ISF machine; and with the workpiece in the intermediate workpiece orientation in the coordinate system of the ISF machine and the tool path of the ISF machine in an intermediate tool-path orientation in the coordinate system of the ISF machine, performing an intermediate forming operation on the workpiece using the ISF machine, before performing the final heat treatment on the workpiece, to achieve an intermediate shape of the workpiece.

9. The method according to claim 8, wherein performing the intermediate heat treatment on the workpiece comprises one of:

mill annealing and cooling the workpiece or solution annealing and quenching the workpiece.

10. The method according to claim 1, further comprising, after performing the initial forming operation on the workpiece in the ISF machine and before performing the final heat treatment on the workpiece:

performing intermediate heat treatments; and performing intermediate forming operations on the workpiece in the ISF machine, wherein the intermediate heat treatments and the intermediate forming operations alternate with each other.

11. The method according to claim 10, wherein performing the intermediate heat treatments comprises at least one of:

mill annealing and cooling the workpiece or solution annealing and quenching of workpiece.

12. A method of forming a workpiece made of a naturally aging alloy to a final shape, the workpiece having an initial heat treatment, the method comprising:

providing an ISF machine having a coordinate system and a tool path corresponding to the final shape of the workpiece;

positioning the workpiece in the ISF machine in an initial workpiece orientation in the coordinate system of the ISF machine;

with the workpiece in the initial workpiece orientation in the coordinate system of the ISF machine and the tool path of the ISF machine in an initial tool-path orientation in the coordinate system of the ISF machine, performing an initial forming operation on the workpiece using the ISF machine;

performing a final heat treatment on the workpiece;

repositioning the workpiece in the ISF machine in a final workpiece orientation in the coordinate system of the ISF machine; and with the workpiece in the final workpiece orientation in the coordinate system of the ISF machine and the tool path of the ISF machine in a final tool-path orientation in the coordinate system of the ISF machine, performing a final forming operation on the workpiece using the ISF machine to achieve the final shape of the workpiece.

13. The method according to claim 12, wherein performing the final heat treatment on the workpiece comprises solution annealing and quenching the workpiece.

14. The method according to claim 13, wherein performing the final heat treatment on the workpiece creates residual stresses in the workpiece, the method further comprising elongating at least a portion of the workpiece a predetermined amount when performing the final forming operation on the workpiece.

15. The method according to claim 12, wherein the final workpiece orientation of the workpiece in the coordinate system of the ISF machine is identical to the initial workpiece orientation of the workpiece in the coordinate system of the ISF machine.

16. The method according to claim 12, wherein the final workpiece orientation of the workpiece in the coordinate system of the ISF machine is different from the initial workpiece orientation of the workpiece in the coordinate system of the ISF machine.

17. The method according to claim 12, further comprising:

performing an intermediate heat treatment on the workpiece after performing the initial forming operation on the workpiece using the ISF machine;

repositioning the workpiece in the ISF machine in an intermediate workpiece orientation in the coordinate system of the ISF machine; and with the workpiece in the intermediate workpiece orientation in the coordinate system of the ISF machine and the tool path of the ISF machine in an intermediate tool-path orientation in the coordinate system of the ISF machine, performing an intermediate forming operation on the workpiece using the ISF machine, before performing the final heat treatment on the workpiece, to achieve an intermediate shape of the workpiece.

18. The method according to claim 17, wherein, when the intermediate heat treatment on the workpiece comprises solution annealing and quenching the workpiece, performing the intermediate forming operation on the workpiece using the ISF machine comprises performing the intermediate forming operation within an intermediate predetermined time period after quenching the workpiece.

19. The method according to claim 12 further comprising, after performing the initial forming operation on the workpiece in the ISF machine and before performing the final heat treatment on the workpiece:

performing intermediate heat treatments; and performing intermediate forming operations on the workpiece in the ISF machine, wherein the intermediate heat treatments and the intermediate forming operations alternate with each other.

20. The method according to claim 19, wherein performing the intermediate heat treatments comprises at least one of:

mill annealing and cooling the workpiece or solution annealing and quenching of the workpiece.

* * * * *